US009719304B2

(12) United States Patent
Radford et al.

(10) Patent No.: US 9,719,304 B2
(45) **Date of Patent: *Aug. 1, 2017**

(54) REMOTELY CONTROLLED APPARATUS FOR DOWNHOLE APPLICATIONS AND METHODS OF OPERATION

(71) Applicant: Baker Hughes Oilfield Operations LLC, Houston, TX (US)

(72) Inventors: Steven R. Radford, The Woodlands, TX (US); Khoi Q. Trinh, Pearland, TX (US); Jason R. Habernal, Magnolia, TX (US); R. Keith Glasgow, Willis, TX (US); John G. Evans, The Woodlands, TX (US); Bruce Stauffer, Spring, TX (US); Johannes Witte, Braunschweig (DE)

(73) Assignee: Baker Hughes Oilfield Operations LLC, Houston, TX (US)

( * ) Notice: Subject to any disclaimer, the term of this patent is extended or adjusted under 35 U.S.C. 154(b) by 331 days.

This patent is subject to a terminal disclaimer.

(21) Appl. No.: 14/537,542

(22) Filed: Nov. 10, 2014

(65) Prior Publication Data

US 2015/0060143 A1 Mar. 5, 2015

Related U.S. Application Data

(63) Continuation of application No. 12/895,233, filed on Sep. 30, 2010, now Pat. No. 8,881,833.
(Continued)

(51) Int. Cl.
*E21B 10/32* (2006.01)
*E21B 33/128* (2006.01)
(Continued)

(52) U.S. Cl.
CPC ..... *E21B 7/28* (2013.01); *E21B 4/02* (2013.01); *E21B 10/322* (2013.01);
(Continued)

(58) Field of Classification Search
CPC .... E21B 10/32; E21B 10/322; E21B 17/1014; E21B 29/005; E21B 33/128; E21B 7/28
See application file for complete search history.

(56) References Cited

U.S. PATENT DOCUMENTS 1,678,075 A 7/1928 Phipps
2,069,482 A 2/1937 Seay
(Continued)

FOREIGN PATENT DOCUMENTS

CA 2108916 A1 4/1994
CN 1816679 A 8/2006
(Continued)

OTHER PUBLICATIONS

International Search Report for International Application No. PCT/US2010/050933 mailed May 9, 2011, 3 pages.
(Continued)

*Primary Examiner* — Cathleen Hutchins
(74) *Attorney, Agent, or Firm* — TraskBritt

(57) ABSTRACT

An apparatus for use downhole is disclosed that, in one configuration includes a downhole tool configured to operate in an active position and an inactive position and an actuation device, which may include a control unit. The apparatus includes a telemetry unit that sends a first pattern recognition signal to the control unit to move the tool into the active position and a second pattern recognition signal to move the tool into the inactive position. The apparatus may be used for drilling a subterranean formation and include a tubular body and one or more extendable features, each positionally coupled to a track of the tubular body, and a drilling fluid
(Continued)

flow path extending through a bore of the tubular body for conducting drilling fluid therethrough. A push sleeve is disposed within the tubular body and coupled to the one or more features. A valve assembly is disposed within the tubular body and configured to control the flow of the drilling fluid into an annular chamber in communication with the push sleeve; the valve assembly comprising a mechanically operated valve and/or an electronically operated valve. Other embodiments, including methods of operation, are provided.

17 Claims, 15 Drawing Sheets

Related U.S. Application Data

(60) Provisional application No. 61/247,162, filed on Sep. 30, 2009, provisional application No. 61/377,146, filed on Aug. 26, 2010.

(51) Int. Cl.

| | |
|---|---|
| ***E21B 7/28*** | (2006.01) |
| ***E21B 17/10*** | (2006.01) |
| ***E21B 47/12*** | (2012.01) |
| ***E21B 4/02*** | (2006.01) |
| ***E21B 21/08*** | (2006.01) |
| ***E21B 21/10*** | (2006.01) |
| ***E21B 23/01*** | (2006.01) |
| ***E21B 34/14*** | (2006.01) |
| ***E21B 49/00*** | (2006.01) |

(52) U.S. Cl.

CPC ..... *E21B 17/1014* (2013.01); *E21B 17/1078* (2013.01); *E21B 21/08* (2013.01); *E21B 21/10* (2013.01); *E21B 23/01* (2013.01); *E21B 34/14* (2013.01); *E21B 47/12* (2013.01); *E21B 49/003* (2013.01)

(56) References Cited

U.S. PATENT DOCUMENTS

| | | | |
|---|---|---|---|
| 2,136,518 | A | 11/1938 | Nixon |
| 2,177,721 | A | 10/1939 | Johnson et al. |
| 2,328,840 | A | 9/1943 | O'Leary |
| 2,344,598 | A | 3/1944 | Church |
| 2,532,418 | A | 12/1950 | Page |
| 2,638,988 | A | 5/1953 | Williams |
| 2,754,089 | A | 7/1956 | Kammerer, Jr. |
| 2,758,819 | A | 8/1956 | Kammerer, Jr. |
| 2,834,578 | A | 5/1958 | Carr |
| 2,874,784 | A | 2/1959 | Baker et al. |
| 2,882,019 | A | 4/1959 | Carr et al. |
| 2,922,627 | A | 1/1960 | Kammerer, Jr. |
| 3,011,558 | A | 12/1961 | Conrad |
| 3,083,765 | A | 4/1963 | Kammerer, Jr. |
| 3,105,562 | A | 10/1963 | Stone et al. |
| 3,123,162 | A | 3/1964 | Rowley |
| 3,126,065 | A | 3/1964 | Chadderdon |
| 3,171,502 | A | 3/1965 | Kammerer, Jr. |
| 3,211,232 | A | 10/1965 | Grimmer |
| 3,224,507 | A | 12/1965 | Cordary, Jr. |
| 3,283,834 | A | 11/1966 | Kammerer, Jr. |
| 3,289,760 | A | 12/1966 | Kammerer, Jr. |
| 3,351,134 | A | 11/1967 | Kammerer, Jr. |
| 3,351,137 | A | 11/1967 | Schulz et al. |
| 3,425,500 | A | 2/1969 | Fuchs |
| 3,433,313 | A | 3/1969 | Brown |
| 3,556,233 | A | 1/1971 | Gilreath |
| 4,067,388 | A | 1/1978 | Mouret et al. |
| 4,403,659 | A | 9/1983 | Upchurch |
| 4,458,761 | A | 7/1984 | Van Vreeswyk |
| 4,491,022 | A | 1/1985 | De La Cruz |
| 4,545,441 | A | 10/1985 | Williamson |
| 4,574,883 | A | 3/1986 | Carroll |
| 4,589,504 | A | 5/1986 | Simpson |
| 4,660,657 | A | 4/1987 | Furse et al. |
| 4,690,229 | A | 9/1987 | Raney |
| 4,693,328 | A | 9/1987 | Furse et al. |
| 4,776,394 | A | 10/1988 | Lynde et al. |
| 4,842,083 | A | 6/1989 | Raney |
| 4,848,490 | A | 7/1989 | Anderson |
| 4,854,403 | A | 8/1989 | Ostertag et al. |
| 4,884,477 | A | 12/1989 | Smith et al. |
| 4,889,197 | A | 12/1989 | Boe |
| 4,893,675 | A | 1/1990 | Skipper |
| 4,893,678 | A | 1/1990 | Stokley et al. |
| 4,938,291 | A | 7/1990 | Lynde et al. |
| 4,971,146 | A | 11/1990 | Terrell |
| 5,018,580 | A | 5/1991 | Skipper |
| 5,101,895 | A | 4/1992 | Gilbert |
| 5,139,098 | A | 8/1992 | Blake |
| 5,168,933 | A | 12/1992 | Pritchard et al. |
| 5,211,241 | A | 5/1993 | Mashaw et al. |
| 5,224,558 | A | 7/1993 | Lee |
| 5,265,684 | A | 11/1993 | Rosenhauch |
| 5,293,945 | A | 3/1994 | Rosenhauch et al. |
| 5,305,833 | A | 4/1994 | Collins |
| 5,309,993 | A | 5/1994 | Coon et al. |
| 5,311,954 | A | 5/1994 | Quintana |
| 5,318,131 | A | 6/1994 | Baker |
| 5,318,137 | A | 6/1994 | Johnson et al. |
| 5,318,138 | A | 6/1994 | Dewey et al. |
| 5,332,048 | A | 7/1994 | Underwood et al. |
| 5,343,963 | A | 9/1994 | Bouldin et al. |
| 5,361,859 | A | 11/1994 | Tibbitts |
| 5,368,114 | A | 11/1994 | Tandberg et al. |
| 5,375,662 | A | 12/1994 | Echols, III et al. |
| 5,425,423 | A | 6/1995 | Dobson et al. |
| 5,437,308 | A | 8/1995 | Morin et al. |
| 5,443,129 | A | 8/1995 | Bailey et al. |
| 5,553,678 | A | 9/1996 | Barr et al. |
| 5,560,440 | A | 10/1996 | Tibbitts et al. |
| 5,740,864 | A | 4/1998 | de Hoedt et al. |
| 5,788,000 | A | 8/1998 | Maury et al. |
| 5,791,409 | A | 8/1998 | Flanders |
| 5,823,254 | A | 10/1998 | Dobson et al. |
| 5,862,870 | A | 1/1999 | Hutchinson |
| 5,887,655 | A | 3/1999 | Haugen et al. |
| 6,039,131 | A | 3/2000 | Beaton |
| 6,059,051 | A | 5/2000 | Jewkes et al. |
| 6,070,677 | A | 6/2000 | Johnston |
| 6,109,354 | A | 8/2000 | Ringgenberg et al. |
| 6,116,336 | A | 9/2000 | Adkins et al. |
| 6,131,675 | A | 10/2000 | Anderson |
| 6,173,795 | B1 | 1/2001 | McGarian et al. |
| 6,189,631 | B1 | 2/2001 | Sheshtawy |
| 6,213,206 | B1 | 4/2001 | Bakke |
| 6,213,226 | B1 | 4/2001 | Eppink et al. |
| 6,227,312 | B1 | 5/2001 | Eppink et al. |
| 6,263,969 | B1 | 7/2001 | Stoesz et al. |
| 6,289,999 | B1 | 9/2001 | Dewey et al. |
| 6,325,151 | B1 | 12/2001 | Vincent et al. |
| 6,378,612 | B1 | 4/2002 | Churchill |
| 6,378,632 | B1 | 4/2002 | Dewey et al. |
| 6,439,305 | B1 | 8/2002 | Bakke et al. |
| 6,488,104 | B1 | 12/2002 | Eppink et al. |
| 6,494,272 | B1 | 12/2002 | Eppink et al. |
| 6,615,933 | B1 | 9/2003 | Eddison |
| 6,668,936 | B2 | 12/2003 | Williamson, Jr. et al. |
| 6,668,949 | B1 | 12/2003 | Rives |
| 6,681,860 | B1 | 1/2004 | Yokley et al. |
| 6,702,020 | B2 | 3/2004 | Zachman et al. |
| 6,708,785 | B1 | 3/2004 | Russell et al. |
| 6,732,817 | B2 | 5/2004 | Dewey et al. |
| 6,854,521 | B2 | 2/2005 | Echols et al. |
| 6,857,473 | B2 | 2/2005 | Cook et al. |
| 6,889,771 | B1 | 5/2005 | Leising et al. |
| 6,978,844 | B2 | 12/2005 | LaFleur |
| 7,036,611 | B2 | 5/2006 | Radford et al. |
| 7,048,078 | B2 | 5/2006 | Dewey et al. |

(56) References Cited

U.S. PATENT DOCUMENTS

| | | | |
|---|---|---|---|
| 7,308,937 | B2 | 12/2007 | Radford et al. |
| 7,314,099 | B2 | 1/2008 | Dewey et al. |
| 7,357,198 | B2 | 4/2008 | Mcgarian et al. |
| 7,383,881 | B2 | 6/2008 | Telfer |
| 7,389,828 | B2 | 6/2008 | Ritter et al. |
| 7,513,318 | B2 | 4/2009 | Underwood et al. |
| 7,604,072 | B2 | 10/2009 | Pastusek et al. |
| 7,886,834 | B2 | 2/2011 | Spencer et al. |
| 7,900,717 | B2 | 3/2011 | Radford et al. |
| 8,028,767 | B2 | 10/2011 | Radford et al. |
| 8,069,916 | B2 | 12/2011 | Giroux et al. |
| 8,074,747 | B2 | 12/2011 | Radford et al. |
| 8,235,144 | B2 | 8/2012 | Rasheed |
| 8,485,277 | B2 | 7/2013 | Huldén et al. |
| 8,511,404 | B2 | 8/2013 | Rasheed |
| 8,528,668 | B2 | 9/2013 | Rasheed |
| 9,097,820 | B2 | 8/2015 | Rasheed |
| 2002/0070052 | A1 | 6/2002 | Armell |
| 2003/0029644 | A1 | 2/2003 | Hoffmaster et al. |
| 2004/0119607 | A1 | 6/2004 | Davies et al. |
| 2004/0134687 | A1 | 7/2004 | Radford et al. |
| 2006/0249307 | A1 | 11/2006 | Ritter et al. |
| 2007/0163808 | A1 | 7/2007 | Campbell et al. |
| 2007/0205022 | A1 | 9/2007 | Treviranus et al. |
| 2007/0246217 | A1 | 10/2007 | Tulloch et al. |
| 2008/0128169 | A1 | 6/2008 | Radford et al. |
| 2008/0128175 | A1 | 6/2008 | Radford et al. |
| 2009/0032308 | A1 | 2/2009 | Eddison |
| 2009/0044944 | A1 | 2/2009 | Murray et al. |
| 2009/0145666 | A1 | 6/2009 | Radford et al. |
| 2009/0173541 | A1 | 7/2009 | Tulloch et al. |
| 2009/0266544 | A1 | 10/2009 | Redlinger et al. |
| 2010/0089583 | A1 | 4/2010 | Xu et al. |
| 2010/0108394 | A1 | 5/2010 | Ollerenshaw et al. |
| 2010/0224414 | A1 | 9/2010 | Radford et al. |
| 2010/0282511 | A1 | 11/2010 | Maranuk et al. |
| 2010/0288557 | A1 | 11/2010 | Radford |
| 2011/0005836 | A1 | 1/2011 | Radford et al. |
| 2011/0073330 | A1 | 3/2011 | Radford |
| 2011/0073371 | A1 | 3/2011 | Radford |
| 2011/0073376 | A1 | 3/2011 | Radford et al. |
| 2011/0127044 | A1 | 6/2011 | Radford et al. |
| 2011/0203849 | A1 | 8/2011 | Radford et al. |
| 2011/0266060 | A1 | 11/2011 | Radford et al. |
| 2011/0284233 | A1 | 11/2011 | Wu et al. |
| 2011/0308861 | A1 | 12/2011 | Radford |
| 2012/0048571 | A1 | 3/2012 | Radford et al. |
| 2012/0080183 | A1 | 4/2012 | Radford et al. |
| 2012/0080231 | A1 | 4/2012 | Radford et al. |
| 2013/0333879 | A1 | 12/2013 | Rasheed |
| 2014/0060933 | A1 | 3/2014 | Rasheed |

FOREIGN PATENT DOCUMENTS

| | | | |
|---|---|---|---|
| EP | 246789 | A2 | 11/1987 |
| EP | 0594420 | A1 | 4/1994 |
| EP | 1036913 | A1 | 10/2002 |
| EP | 1044314 | A1 | 3/2005 |
| EP | 1614852 | A1 | 11/2006 |
| EP | 2327857 | B1 | 3/2014 |
| GB | 2328964 | A | 3/1999 |
| GB | 2344122 | A | 5/2000 |
| GB | 2344607 | A | 6/2000 |
| GB | 2319276 | B | 2/2001 |
| GB | 2353310 | A | 2/2001 |
| GB | 2344607 | B | 2/2003 |
| GB | 2344122 | B | 4/2003 |
| GB | 2393461 | B | 10/2006 |
| GB | 2426269 | B | 2/2007 |
| GB | 2441286 | B | 3/2008 |
| GB | 2438333 | B | 12/2008 |
| GB | 2437878 | B | 7/2009 |
| GB | 2446745 | B | 8/2009 |
| GB | 2460096 | A | 11/2009 |
| GB | 2420803 | B | 1/2010 |
| GB | 2465504 | A | 5/2010 |
| GB | 2465505 | A | 5/2010 |
| GB | 2449594 | B | 11/2010 |
| GB | 2476653 | A | 6/2011 |
| GB | 2455242 | B | 7/2011 |
| GB | 2470159 | B | 7/2012 |
| GB | 2473561 | B | 7/2012 |
| GB | 2479298 | B | 12/2013 |
| GB | 2521528 | A | 6/2015 |
| WO | 0031371 | A1 | 6/2000 |
| WO | 2008/150290 | A1 | 12/2008 |
| WO | 2009/156552 | A1 | 12/2009 |
| WO | 2011/080640 | A2 | 7/2011 |
| WO | 2013/166393 | A1 | 11/2013 |

OTHER PUBLICATIONS

International Written Opinion for International Application No. PCT/US2010/050933 mailed May 9, 2011, 3 pages.4 pages.

International Preliminary Report on Patentability for International Application No. PCT/US2010/050933 dated Apr. 3, 2012, 6 pages.

U.S. Appl. No. 60/399,531, filed Jul. 30, 2002, titled Expandable Reamer Apparatus for Enlarging Boreholes While Drilling and Method of Use, to Radford et al.

REMOTELY CONTROLLED APPARATUS FOR DOWNHOLE APPLICATIONS AND METHODS OF OPERATION

CROSS-REFERENCE TO RELATED APPLICATIONS

This application is a continuation of U.S. patent application Ser. No. 12/895,233, filed Sep. 30, 2010, now U.S. Pat. No. 8,881,833, issued Nov. 11, 2014, which application claims the benefit of U.S. Provisional Application Ser. No. 61/247,162, filed Sep. 30, 2009, entitled "Remotely Activated and Deactivated Expandable Apparatus for Earth Boring Applications," and claims the benefit of U.S. Provisional Patent Application Ser. No. 61/377,146, entitled "Remotely-Controlled Device and Method for Downhole Actuation" filed Aug. 26, 2010, the disclosure of each of which is hereby incorporated herein in its entirety by this reference. This application is also related to U.S. patent application Ser. No. 13/169,743, filed Jun. 27, 2011, now U.S. Pat. No. 9,175,520, issued Nov. 3, 2015, for "Remotely Controlled Apparatus for Downhole Applications, Components for Such Apparatus, Remote Status Indication Devices for such Apparatus, and Related Methods," and to U.S. patent application Ser. No. 13/252,644, filed Oct. 4, 2011, now U.S. Pat. No. 8,464,812, issued Jun. 18, 2013, for "Remotely Controlled Apparatus for Downhole Applications and Related Methods."

TECHNICAL FIELD

Embodiments of the present invention relate generally to remotely controlled apparatus for use in a subterranean borehole and, more particularly, in some embodiments to an expandable reamer apparatus for enlarging a subterranean borehole, to an expandable stabilizer apparatus for stabilizing a bottom hole assembly during a drilling operation, in other embodiments to other apparatus for use in a subterranean borehole, and in still other embodiments to an actuation device and system.

BACKGROUND

Wellbores, also called boreholes, for hydrocarbon (oil and gas) production, as well as for other purposes, such as, for example, geothermal energy production, are drilled with a drill string that includes a tubular member (also referred to as a drilling tubular) having a drilling assembly (also referred to as the drilling assembly or bottom hole assembly or "BHA") which includes a drill bit attached to the bottom end thereof. The drill bit is rotated to shear or disintegrate material of the rock formation to drill the wellbore. The drill string often includes tools or other devices that need to be remotely activated and deactivated during drilling operations. Such tools and devices include, among other things, reamers, stabilizers or force application members used for steering the drill bit, Production wells include devices, such as valves, inflow control device, etc., that are remotely controlled. The disclosure herein provides a novel apparatus for controlling such and other downhole tools or devices.

Expandable tools are typically employed in downhole operations in drilling oil, gas and geothermal wells. For example, expandable reamers are typically employed for enlarging a subterranean borehole. Conventionally in drilling oil, gas, and geothermal wells, a casing string (such term broadly including a liner string) is installed and cemented to prevent the wellbore walls from caving into the subterranean borehole while providing requisite shoring for subsequent drilling operations to achieve greater depths. Casing is also conventionally installed to isolate different formations, to prevent crossflow of formation fluids, and to enable control of formation fluids and pressure as the borehole is drilled. To increase the depth of a previously drilled borehole, new casing is laid within and extended below the previous casing. While adding additional casing allows a borehole to reach greater depths, it has the disadvantage of narrowing the borehole. Narrowing the borehole restricts the diameter of any subsequent sections of the well because the drill bit and any further casing must pass through the existing casing. As reductions in the borehole diameter are undesirable because they limit the production flow rate of oil and gas through the borehole, it is often desirable to enlarge a subterranean borehole to provide a larger borehole diameter for installing additional casing beyond previously installed casing as well as to enable better production flow rates of hydrocarbons through the borehole.

A variety of approaches have been employed for enlarging a borehole diameter. One conventional approach used to enlarge a subterranean borehole includes using eccentric and bi-center bits. For example, an eccentric bit with a laterally extended or enlarged cutting portion is rotated about its axis to produce an enlarged borehole diameter. A bi-center bit assembly employs two longitudinally superimposed bit sections with laterally offset longitudinal axes, which when the bit is rotated produce an enlarged borehole diameter.

Another conventional approach used to enlarge a subterranean borehole includes employing an extended bottom hole assembly with a pilot drill bit at the distal end thereof and a reamer assembly some distance above. This arrangement permits the use of any standard rotary drill bit type, be it a rock bit or a drag bit, as the pilot bit, and the extended nature of the assembly permits greater flexibility when passing through tight spots in the borehole as well as the opportunity to effectively stabilize the pilot drill bit so that the pilot hole and the following reamer will traverse the path intended for the borehole. This aspect of an extended bottom hole assembly is particularly significant in directional drilling. One design to this end includes so-called "reamer wings," which generally comprise a tubular body having a fishing neck with a threaded connection at the top thereof and a tong die surface at the bottom thereof, also with a threaded connection. The upper midportion of the reamer wing tool includes one or more longitudinally extending blades projecting generally radially outwardly from the tubular body, the outer edges of the blades carrying PDC cutting elements.

As mentioned above, conventional expandable reamers may be used to enlarge a subterranean borehole and may include blades pivotably or hingedly affixed to a tubular body and actuated by way of a piston disposed therein. In addition, a conventional borehole opener may be employed comprising a body equipped with at least two hole opening arms having cutting means that may be moved from a position of rest in the body to an active position by exposure to pressure of the drilling fluid flowing through the body. The blades in these reamers are initially retracted to permit the tool to be run through the borehole on a drill string and once the tool has passed beyond the end of the casing, the blades are extended so the bore diameter may be increased below the casing.

The blades of some conventional expandable reamers have been sized to minimize a clearance between themselves and the tubular body in order to prevent any drilling mud and earth fragments from becoming lodged in the clearance and binding the blade against the tubular body. The blades of these conventional expandable reamers utilize pressure from inside the tool to apply force radially outward against pistons which move the blades, carrying cutting elements, laterally outward. It is felt by some that the nature of some conventional reamers allows misaligned forces to cock and jam the pistons and blades, preventing the springs from retracting the blades laterally inward. Also, designs of some conventional expandable reamer assemblies fail to help blade retraction when jammed and pulled upward against the borehole casing. Furthermore, some conventional hydraulically actuated reamers utilize expensive seals disposed around a very complex shaped and expensive piston, or blade, carrying cutting elements. In order to prevent cocking, some conventional reamers are designed having the piston shaped oddly in order to try to avoid the supposed cocking, requiring matching, complex seal configurations. These seals are feared to possibly leak after extended usage.

Notwithstanding the various prior approaches to drill and/or ream a larger diameter borehole below a smaller diameter borehole, the need exists for improved apparatus and methods for doing so. For instance, bi-center and reamer wing assemblies are limited in the sense that the pass through diameter of such tools is nonadjustable and limited by the reaming diameter. Furthermore, conventional bi-center and eccentric bits may have the tendency to wobble and deviate from the path intended for the borehole. Conventional expandable reaming assemblies, while sometimes more stable than bi-center and eccentric bits, may be subject to damage when passing through a smaller diameter borehole or casing section, may be prematurely actuated, and may present difficulties in removal from the borehole after actuation.

BRIEF SUMMARY

Various embodiments of the present disclosure are directed to expandable apparatuses. In one or more embodiments, an expandable apparatus may comprise a tubular body comprising a fluid passageway extending through an inner bore. A push sleeve may be disposed within the inner bore of the tubular body and may be coupled to one or more expandable features. The push sleeve may comprise a lower surface in communication with a lower annular chamber. The push sleeve may be configured to move axially responsive to a flow of drilling fluid through the fluid passageway to extend and retract the one or more expandable features. A valve may be positioned within the tubular body and configured to selectively control the flow of a drilling fluid into the lower annular chamber.

In one or more additional embodiments, an expandable apparatus may comprise a tubular body and one or more expandable features. The one or more expandable features are configured to expand and retract an unlimited number of times. The expandable apparatus may be configured as an expandable reamer, an expandable stabilizer, or other expandable apparatus.

Additional embodiments of the disclosure are directed to methods of operating an expandable apparatus. One or more embodiments of such methods may comprise flowing a drilling fluid through a fluid passageway located in a tubular body of an expandable apparatus. A force may be exerted on the push sleeve disposed within the tubular body sufficient to bias the push sleeve axially downward and to retract one or more expandable features coupled to the push sleeve. A valve coupled to a valve port that extends between the fluid passageway and a lower annular chamber may be opened and drilling fluid may flow into the lower annular chamber in communication with a lower surface of the push sleeve. A force may be exerted by the drilling fluid on the lower surface of the push sleeve, moving the push sleeve axially upward and expanding the one or more expandable features coupled to the push sleeve.

In one or more additional embodiments, a method of operating an expandable apparatus may comprise expanding at least one expandable feature coupled to a tubular body and retracting the at least one expandable feature. The foregoing sequence of expanding and retracting can be repeated an unlimited number of times.

Still other embodiments of the disclosure comprise push sleeves employable with an expandable apparatus. In one or more embodiments, such push sleeves may comprise means for coupling the push sleeve to one or more expandable features. The push sleeve may further include an upper annular surface and a lower annular surface, the lower annular surface comprising a larger surface area than the upper annular surface.

In a further embodiment, an apparatus for use downhole is disclosed that in one configuration includes a downhole tool configured to move between a first mode and second mode which, for some applications, may be further respectively characterized as an inactive position and an active position.

In yet a further embodiment, an actuation device includes a housing including an annular chamber configured to house a first fluid therein, a piston in the annular chamber configured to divide the annular chamber into a first section and a second section, the piston being coupled to a biasing member, and a control unit configured to move the first fluid from the first section to the second section to supply a second fluid under pressure to a downhole tool to move the tool into the active position and from the second section to the first section to stop the supply of the second fluid to the tool to cause the tool to move into the inactive position.

In another embodiment, the apparatus comprises a system including a telemetry unit that sends a first pattern recognition signal to the control unit to move the tool into the active position and a second pattern recognition signal to move the tool into the inactive position.

DETAILED DESCRIPTION

The illustrations presented herein are, in some instances, not actual views of any particular expandable apparatus, but are merely idealized representations that are employed to describe the present invention. Additionally, elements common between figures may retain the same numerical designation.

Figure 1:
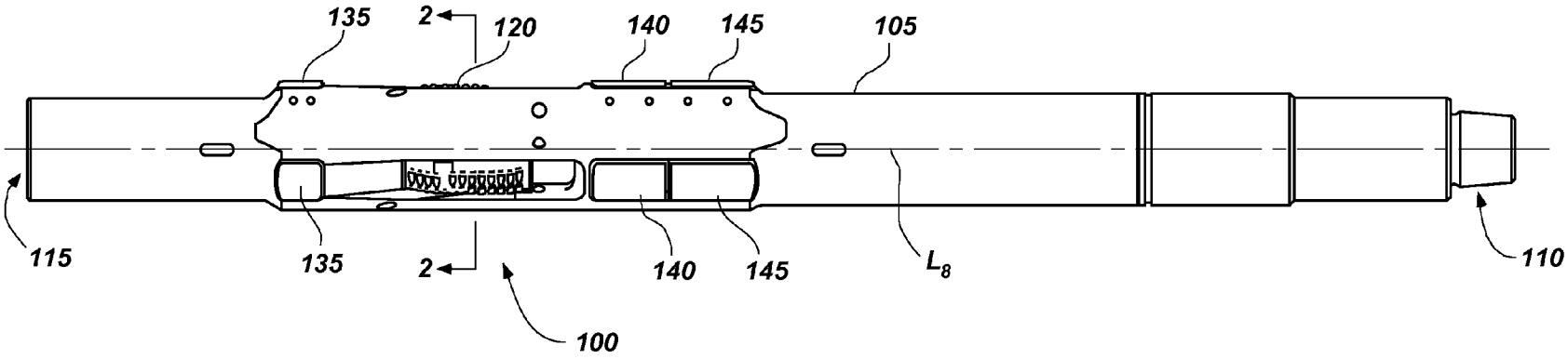
FIG. 1 is a side view of an embodiment of an expandable apparatus of the disclosure.

Various embodiments of the disclosure are directed to expandable apparatus. By way of example and not limitation, an expandable apparatus may comprise an expandable reamer apparatus, an expandable stabilizer apparatus or similar apparatus. FIG. 1 illustrates an expandable apparatus 100 according to an embodiment of the disclosure comprising an expandable reamer. The expandable reamer may be similar to the expandable apparatus described in U.S. Patent Publication No. 2008/0128175, now U.S. Pat. No. 7,900,717, issued Mar. 8, 2011, the entire disclosure of which is incorporated herein by this reference.

The expandable apparatus 100 may include a generally cylindrical tubular body 105 having a longitudinal axis $L_8$. The tubular body 105 of the expandable apparatus 100 may have a lower end 110 and an upper end 115. The terms "lower" and "upper," as used herein with reference to the ends 110, 115, refer to the typical positions of the ends 110, 115 relative to one another when the expandable apparatus 100 is positioned within a wellbore. The lower end 110 of the tubular body 105 of the expandable apparatus 100 may include a set of threads (e.g., a threaded male pin member) for connecting the lower end 110 to another section of a drill string or another component of a bottom hole assembly (BHA), such as, for example, a drill collar or collars carrying a pilot drill bit for drilling a wellbore. Similarly, the upper end 115 of the tubular body 105 of the expandable apparatus 100 may include a set of threads (e.g., a threaded female box member) for connecting the upper end 115 to another section of a drill string or another component of a bottom hole assembly (BHA) (e.g., an upper sub).

Figure 4:
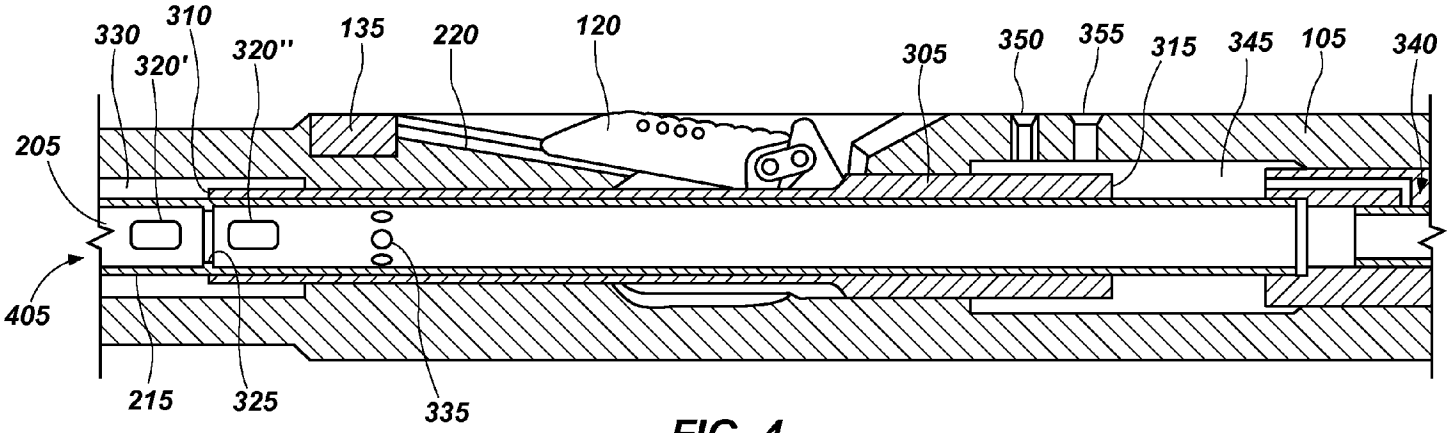
FIG. 4 shows an enlarged longitudinal cross-sectional view of a portion of the expandable apparatus shown in FIG. 3.

At least one expandable feature may be positioned along the expandable apparatus 100. For example, three expandable features configured as sliding cutter blocks or blades 120, 125, 130 (see FIG. 2) are positionally retained in circumferentially spaced relationship in the tubular body 105 as further described below and may be provided at a position along the expandable apparatus 100 intermediate the lower end 110 and the upper end 115. The blades 120, 125, 130 may be comprised of steel, tungsten carbide, a particle-matrix composite material (e.g., hard particles dispersed throughout a metal matrix material), or other suitable materials as known in the art. The blades 120, 125, 130 are retained in an initial, retracted position within the tubular body 105 of the expandable apparatus 100 as illustrated in FIG. 4, but may be moved responsive to application of hydraulic pressure into the extended position (shown in FIG. 5) and moved into a retracted position (shown in FIG. 4) when desired, as will be described herein. The expandable apparatus 100 may be configured such that the blades 120, 125, 130 engage the walls of a subterranean formation surrounding a wellbore in which apparatus 100 is disposed to remove formation material when the blades 120, 125, 130 are in the extended position, but are not operable to so engage the walls of a subterranean formation within a wellbore when the blades 120, 125, 130 are in the retracted position. While the expandable apparatus 100 includes three blades 120, 125, 130, it is contemplated that one, two or more than three blades may be utilized to advantage. Moreover, while the blades 120, 125, 130 are symmetrically circumferentially positioned axially along the tubular body 105, the blades may also be positioned circumferentially asymmetrically as well as asymmetrically along the longitudinal axis $L_8$ in the direction of either end 110 or 115.

The expandable apparatus 100 may optionally include a plurality of stabilizer blocks 135, 140 and 145. In some embodiments, the mid stabilizer block 140 and the lower stabilizer block 145 may be combined into a unitary stabilizer block. The stabilizer blocks 135, 140, 145 help to center the expandable apparatus 100 in the drill hole while being run into position through a casing or liner string and also while drilling and reaming the borehole. In other embodiments, no stabilizer blocks may be employed. In such embodiments, the tubular body 105 may comprise a larger outer diameter in the longitudinal portion where the stabilizer blocks are shown in FIG. 1 to provide a similar centering function as provided by the stabilizer blocks.

The upper stabilizer block 135 may be used to stop or limit the forward motion of the blades 120, 125, 130 (see also FIG. 3), determining the extent to which the blades 120, 125, 130 may engage a borehole while drilling. The upper stabilizer block 135, in addition to providing a back stop for limiting the lateral extent of the blades when extended, may provide for additional stability when the blades 120, 125, 130 are retracted and the expandable apparatus 100 of a drill string is positioned within a borehole in an area where an expanded hole is not desired while the drill string is rotating. Advantageously, the upper stabilizer block 135 may be mounted, removed and/or replaced by a technician, particularly in the field, allowing the extent to which the blades 120, 125, 130 engage the borehole to be readily increased or decreased to a different extent than illustrated. Optionally, it is recognized that a stop associated on a track side of the upper stabilizer block 135 may be customized in order to arrest the extent to which the blades 120, 125, 130 may laterally extend when fully positioned to the extended position along blade tracks 220. The stabilizer blocks 135, 140, 145 may include hardfaced bearing pads (not shown) to provide a surface for contacting a wall of a borehole while stabilizing the expandable apparatus 100 therein during a drilling operation.

Figure 2:
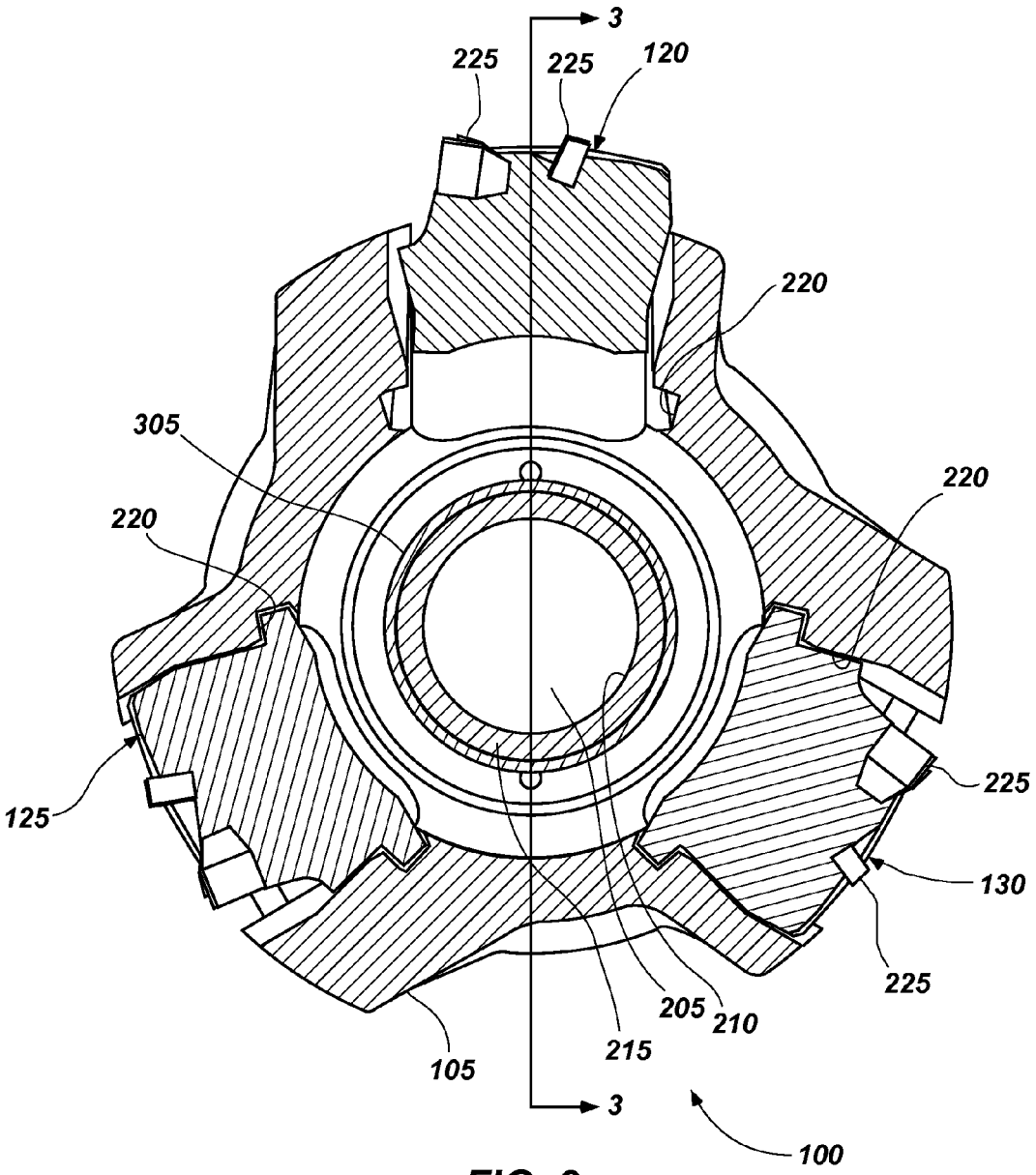
FIG. 2 shows a transverse cross-sectional view of the expandable apparatus as indicated by section line 2-2 in FIG. 1.

FIG. 2 is a cross-sectional view of the expandable apparatus 100 shown in FIG. 1 taken along section line 2-2 shown therein. As shown in FIG. 2, the tubular body 105 encloses a fluid passageway 205 that extends longitudinally through the tubular body 105. The fluid passageway 205 directs fluid substantially through an inner bore 210 of a stationary sleeve 215. To better describe aspects of the invention, blades 125 and 130 are shown in FIG. 2 in the initial or retracted positions, while blade 120 is shown in the outward or extended position. The expandable apparatus 100 may be configured such that the outermost radial or lateral extent of each of the blades 120, 125, 130 is recessed within the tubular body 105 when in the initial or retracted positions so it may not extend beyond the greatest extent of outer diameter of the tubular body 105. Such an arrangement may protect the blades 120, 125, 130, a casing, or both, as the expandable apparatus 100 is disposed within the casing of a borehole, and may allow the expandable apparatus 100 to pass through such casing within a borehole. In other embodiments, the outermost radial extent of the blades 120, 125, 130 may coincide with or slightly extend beyond the outer diameter of the tubular body 105. As illustrated by blade 120, the blades 120, 125, 130 may extend beyond the outer diameter of the tubular body 105 when in the extended position, to engage the walls of a borehole in a reaming operation.

Figure 3:
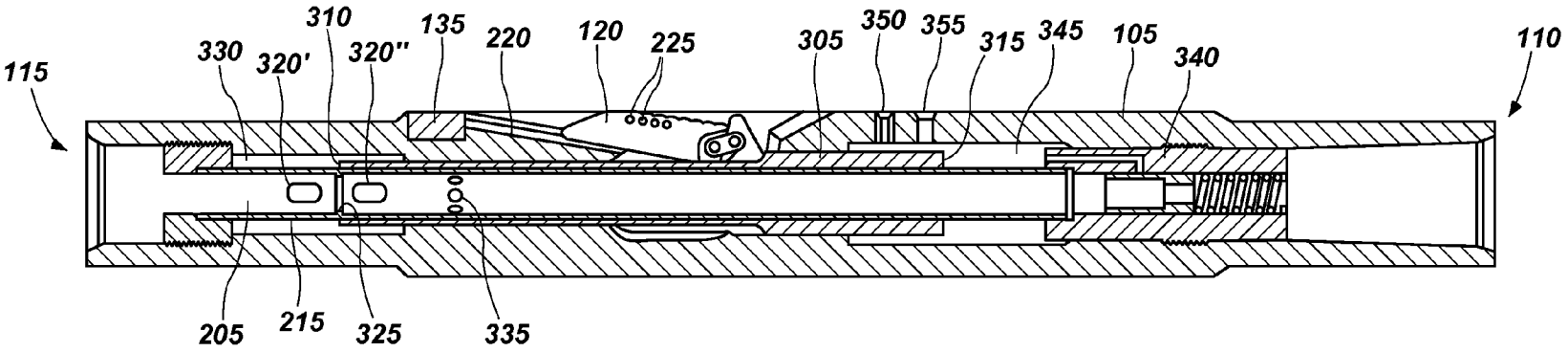
FIG. 3 shows a longitudinal cross-sectional view of the expandable apparatus shown in FIG. 1.

FIG. 3 is another cross-sectional view of the expandable apparatus 100 shown in FIGS. 1 and 2 taken along section line 3-3 shown in FIG. 2. Referring to FIGS. 2 and 3, the tubular body 105 positionally retains three sliding cutter blocks or blades 120, 125, 130 in three respective blade tracks 220. The blades 120, 125, 130 each carry a plurality of cutting elements 225 for engaging the material of a subterranean formation defining the wall of an open borehole when the blades 120, 125, 130 are in an extended position. The cutting elements 225 may be polycrystalline diamond compact (PDC) cutters or other cutting elements known to a person of ordinary skill in the art and as generally described in U.S. Pat. No. 7,036,611, the disclosure of which is incorporated herein in its entirety by this reference.

Referring to FIG. 3, the blades 120, 125, 130 (as illustrated by blade 120) are hingedly coupled to a push sleeve 305. The push sleeve 305 is disposed encircling the stationary sleeve 215 and configured to slide axially within the tubular body 105 in response to pressures applied to one end or the other, or both. In some embodiments, the push sleeve 305 may be disposed in the tubular body 105 and may be configured similar to the push sleeve described by U.S. Patent Publication No. 2008/0128175, now U.S. Pat. No. 7,900,717, issued Mar. 8, 2011, referenced above and biased by a spring as described therein.

In other embodiments, the push sleeve 305 may comprise an upper surface 310 and a lower surface 315 at opposing longitudinal ends. Such a push sleeve 305 may be configured and positioned so that the upper surface 310 comprises a smaller annular surface area than the lower surface 315 to create a greater force on the lower surface 315 than on the upper surface 310 when a like pressure is exerted on both surfaces by a pressurized fluid, as described in more detail below.

The stationary sleeve 215 comprises at least two fluid ports 320' and 320" and generally referred to collectively as fluid ports 320, axially separated by a necked down orifice 325 proximate an upper end of the stationary sleeve 215. The fluid ports 320 are positioned in communication with an upper annular chamber 330 located between an inner sidewall of the tubular body 105 and the outer surfaces of the stationary sleeve 215, and in communication with the upper surface 310 of the push sleeve 305. The stationary sleeve 215 may further include a plurality of nozzle ports 335 that may selectively communicate with a plurality of nozzles (not shown) for directing a drilling fluid toward the blades 120, 125, 130 when the blades are extended. A valve 340 is coupled to the lower end of the stationary sleeve 215 to selectively control the flow of fluid from the fluid passageway 205 to a lower annular chamber 345 between the inner sidewall of the tubular body 105 and the outer surfaces of the stationary sleeve 215, and in communication with the lower surface 315 of the push sleeve 305.

In operation, the push sleeve 305 is originally positioned toward the lower end 110 with the valve 340 closed, as shown in FIG. 4. A fluid, such as a drilling fluid, may be flowed through the fluid passageway 205 in the direction of arrow 405. Some of the fluid flowing through the fluid passageway 205 of the stationary sleeve 215 also flows through an upper fluid port 320' into the upper annular chamber 330. The pressure causing the fluid to flow through the fluid passageway 205 and into the upper annular chamber 330 exerts a force on the upper surface 310 of the push sleeve 305, driving the push sleeve 305 toward the lower end 110. When the push sleeve 305 is driven to the axially lower limit of its path of travel, the blades 120, 125, 130 (as illustrated by blade 120) are fully retracted.

Figure 5:
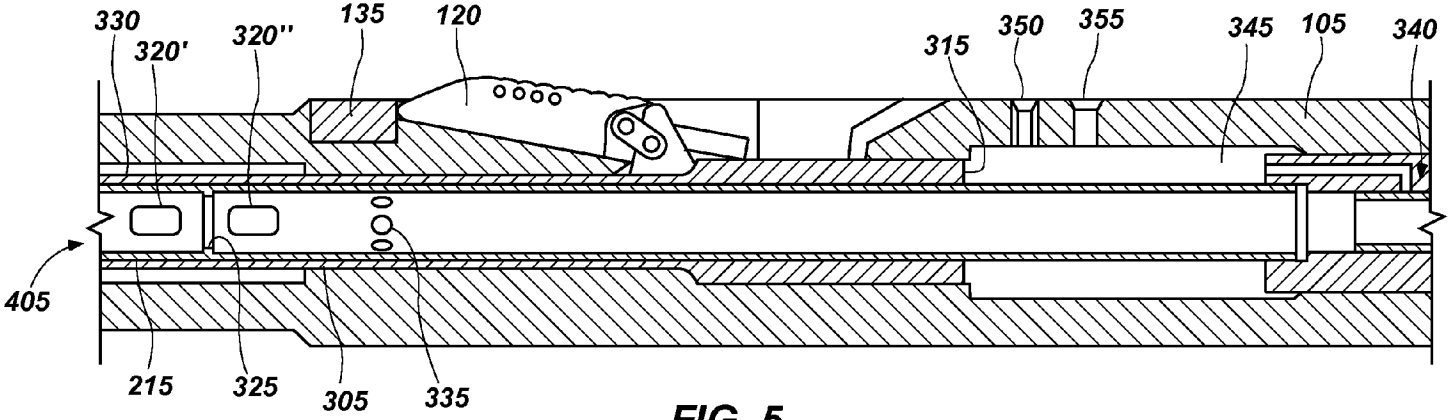
FIG. 5 shows an enlarged cross-sectional view of the same portion of the expandable apparatus shown in FIG. 4 and with the blades expanded.

When the valve 340 is selectively opened, as will be described in greater detail below, the fluid also flows from the fluid passageway 205 into the lower annular chamber 345, causing the fluid to pressurize the lower annular chamber 330, exerting a force on the lower surface 315 of the push sleeve 305. As described above, the lower surface 315 of the push sleeve 305 has a larger surface area than the upper surface 310. Therefore, with equal or substantially equal pressures applied to the upper surface 310 and lower surface 315 by the fluid, the force applied on the lower surface 315, having the larger surface area, will be greater than the force applied on the upper surface 310, having the smaller surface area, by virtue of the fact that force is equal to the pressure applied multiplied by the area to which it is applied. The resultant net force is upward, causing the push sleeve 305 to slide upward, and extending the blades 120, 125, 130, as shown in FIG. 5. By way of example and not limitation, in an embodiment in which the difference in pressure between inside the expandable apparatus 100 and outside the expandable apparatus 100 is about 1,000 (one thousand) psi (about 6.894 MPa) and the difference between surface area of the upper surface 310 and the surface area of the lower surface 315 is about 14 $in^2$ (about 90 $cm^2$), the net upward force would be about 14,000 (fourteen thousand) lbs (about 62.275 kN).

When it is desired to retract the blades 120, 125, 130, the valve 340 is closed to inhibit the fluid from flowing into the lower annular chamber 345 and applying a pressure on the lower surface 315 of the push sleeve 305. When the valve 340 is closed, a volume of drilling fluid will remain trapped in the lower annular chamber 345. At least one pressure relief nozzle 350 may accordingly be provided, extending through the sidewall of the tubular body 105 to allow the drilling fluid to escape from the lower annular chamber 345 and into an area between the borehole wall and the expandable apparatus 100 when the valve 340 is closed. The one or more pressure relief nozzles 350 may comprise a relatively small flow path so that a significant amount of pressure is not lost when the valve 340 is opened and the drilling fluid fills the lower annular chamber 345. By way of example and not limitation, at least one embodiment of the pressure relief nozzle 350 may comprise a flow path of about 0.125 inch (about 3.175 mm) in diameter. In addition to the one or more pressure relief nozzles 350, at least one high pressure release device 355 may be provided to provide pressure release should the pressure relief nozzle 350 fail (e.g., become plugged). The at least one high pressure release device 355 may comprise, for example, a backup burst disk, a high pressure check valve, or other device. In at least some embodiments, a screen (not shown) may be positioned over the at least one pressure relief nozzle 350 and the at least one high pressure release device 355 on both sides of the sidewall of tubular body 105 to inhibit the flow of materials that may plug at least one pressure relief nozzle 350 and the at least one high pressure release device 355.

In the non-limiting example set forth above in which the difference in pressure between inside the expandable apparatus 100 and outside the expandable apparatus 100 is about 1,000 (one thousand) psi (about 6.894 MPa) and the surface area of the upper surface 310 is about 3 $in^2$ (about 19.3 $cm^2$), the net downward force would be about 3,000 (three thousand) lbs (about 13.345 kN) to bias the push sleeve 305 downward.

As stated above, the stationary sleeve 215 includes a necked down orifice 325 near the upper portion thereof between the upper fluid port 320' and the lower fluid port 320". The necked down orifice 325 comprises a portion of the stationary sleeve 215 in which the diameter of the inner bore 210 is reduced. By reducing the diameter through which the drilling fluid may flow, the necked down orifice 325 creates an increased pressure upstream from the necked down orifice 325. The increased pressure above the necked down orifice 325 is typically monitored by conventional devices and this monitored pressure is conventionally referred to as the "monitored standpipe pressure."

In at least some embodiments, when the push sleeve 305 is positioned at the axially lower limit of its path of travel and the blades 120, 125, 130 are fully retracted, the upper fluid port 320' is exposed to the upper annular chamber 330, but the lower fluid port 320" is at least substantially closed by the sidewall of the push sleeve 305. Similarly, nozzle ports 335 may be closed by the sidewall of the push sleeve 305 since the blades 120, 125, 130 are not engaging the borehole and do not need to be cleaned and cooled and no cuttings need to be washed to the surface of the borehole. When the push sleeve 305 is repositioned to the axially upper limit of its path of travel so the blades 120, 125, 130 are fully extended, the upper fluid port 320', the lower fluid port 320" and the nozzle ports 335 are all aligned with one or more openings (not shown) in the sidewall of push sleeve 305 so that fluid may flow through these ports 320', 320", 335.

The fluid flowing through the nozzle ports 335 is directed to one or more nozzles (not shown) to cool and clean the blades 120, 125, 130. With both the fluid ports 320 open to the upper annular chamber 330, the fluid exits the upper fluid port 320' above the necked down orifice 325, into the upper annular chamber 330 and then back into the fluid passageway 205 through the lower fluid port 320" below the necked down orifice 325. This increases the total flow area through which the drilling fluid may flow (e.g., through the necked down orifice 325 and through the upper annular chamber 330 by means of the fluid ports 320. The increase in the total flow area results in a substantial reduction in fluid pressure above the necked down orifice 325. This decrease in pressure may be detected by an operator and identified in data comprising the monitored standpipe pressure, and may indicate to the operator that the blades 120, 125, 130 of the expandable apparatus 100 are in the expanded position. In other words, the decrease in pressure may provide a signal to the operator that the blades 120, 125, 130 have been expanded for engaging the borehole.

In at least some embodiments, the pressure drop may be between about 140 psi and about 270 psi. In one non-limiting example, the stationary sleeve 215 may comprise an inner bore of about 2.25 inch (about 57.2 mm) and the fluid ports 320 may be about 2 inches (50.8 mm) long and about 1 inch (25.4 mm) wide. In such an embodiment, a necked down orifice 325 comprising an inner diameter of about 1.625 inches (about 41.275 mm) will result in a drop in the monitored standpipe pressure of about 140 psi (about 965 kPa), assuming there are no nozzles, (the nozzles being optional according to various embodiments). In another example of such an embodiment, a necked down orifice 325 comprising an inner diameter of about 1.4 inches (about 35.56 mm) will result in a drop in the monitored standpipe pressure of about 269 psi (about 1.855 MPa).

Figure 6:
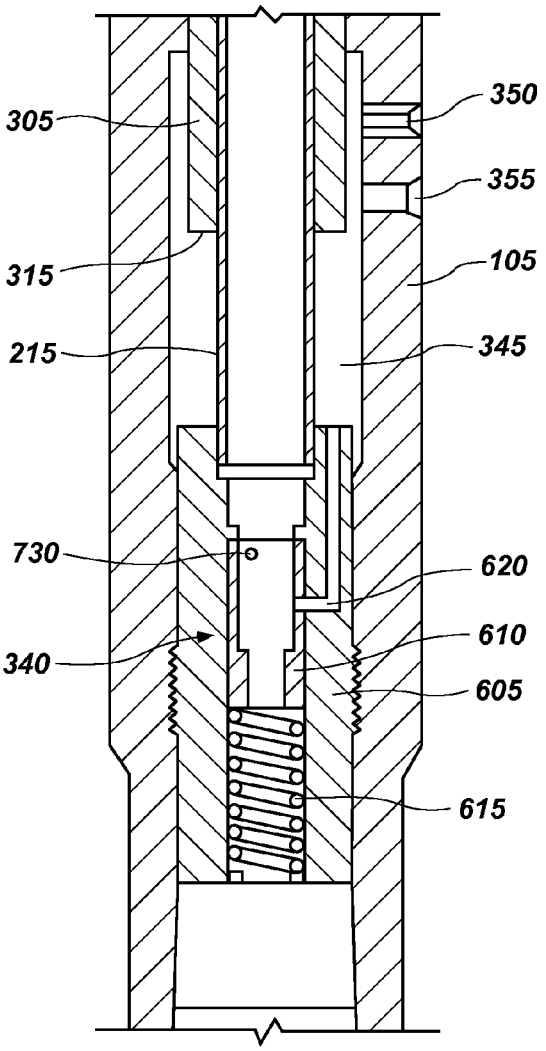
FIG. 6 shows an enlarged cross-sectional view of a valve according to at least one embodiment for a mechanically controlled valve.

Various embodiments of the present disclosure may employ mechanically actuated or controlled valves 340 or electronically actuated or controlled valves 340. FIG. 6 illustrates an embodiment comprising a mechanically operated valve 340. The mechanically operated valve 340 comprises a valve configured to open or to close in response to one or more mechanical forces. For example, in at least one embodiment, the valve 340 may comprise a valve sleeve 605 disposed within the tubular body 105 and coupled to a lower end of the stationary sleeve 215. A valve cylinder 610 is disposed within the valve sleeve 605 and configured to selectively expose one or more valve ports 620, through which a fluid may flow between the fluid passageway 205 and the lower annular chamber 345.

Figure 7:
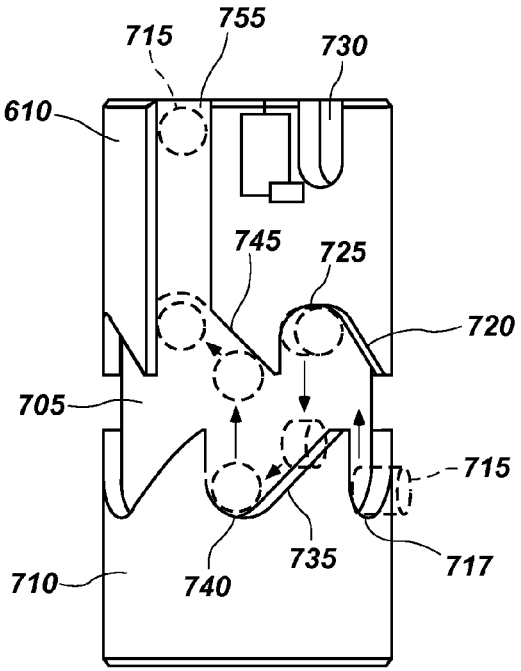
FIG. 7 shows a side view of a valve cylinder according to an embodiment of the valve shown in FIG. 6.

With continued reference to FIG. 6, FIG. 7 illustrates at least one embodiment of a valve cylinder 610 configured to be coupled with the valve sleeve 605 with a pin and pin track configuration. For example, the valve cylinder 610 may comprise a pin track formed in an outer surface thereof and configured to receive one or more pins on an inner surface of the valve sleeve 605. In other embodiments, the valve cylinder 610 may comprise one or more pins on the outer surface thereof and the valve sleeve 605 may comprise a pin track formed in an inner surface for receiving the one or more pins of the valve cylinder 610. FIG. 7 illustrates a valve cylinder 610 comprising a pin track 705 formed in an outer surface 710 according to one embodiment in which the pin track 705 comprises a J-slot configuration.

In operation, the valve cylinder 610 may be biased by a spring 615 exerting a force in the upward direction. The valve cylinder 610 may be configured with at least a portion having a reduced inner diameter, providing a constriction to downward flow of drilling fluid. When a drilling fluid flows through the valve cylinder 610 and the reduced inner diameter thereof, the pressure above the constriction created by the reduced inner diameter may be sufficient to overcome the upward force exerted by the spring 615, causing the valve cylinder 610 to bias downward and the spring 615 to compress. If the flow of drilling fluid is eliminated or reduced below a selected threshold, the upward force exerted by the spring 615 may be sufficient to bias the valve cylinder 610 at least partially upward.

Referring to FIGS. 6 and 7, one or more pins, such as pin 715 shown in dotted lines and carried by valve sleeve 605, is received by the pin track 705. Valve cylinder 610 is longitudinally and rotationally guided by the engagement of one or more pins 715 with pin track 705 when the cylinder 610 is biased downward and upward. For example, when there is relatively little or no fluid flow through the valve cylinder 610, the force exerted by the spring 615 biases the valve cylinder 610 upward and the pin 715 rests in a first lower hooked portion 717 of the pin track 705, as shown at the rightmost side of FIG. 7. When drilling fluid is flowed through the valve cylinder 610 at a sufficient flow rate to overcome the force exerted by spring 615 and the valve cylinder 610 is biased downward, the track 705 moves along pin 715 until pin 715 comes into contact with an upper angled sidewall 720 of the pin track 705. Movement of the valve cylinder 610 continues as pin 715 is engaged by the upper angled sidewall 720 until the pin 715 sits in a first upper hooked portion 725. As the track 705 and its upper angled sidewall 720 is engaged by pin 715, the valve cylinder 610 is forced to rotate, assuming the valve sleeve 605 to which the pin 715 is attached is fixed within the tubular body 105. The rotation of the valve cylinder 610 may cause one or more apertures 730 in the valve cylinder 610 to move out of alignment with one or more valve ports 620 in communication with the lower annular chamber 345, inhibiting flow of the drilling fluid from inside the valve 340 to the lower annular chamber 345.

In order to open the valve 340, according to the embodiment of FIG. 7, the drilling fluid pressure may be reduced or eliminated, causing the valve cylinder 610 to bias upward in response to the force of the spring 615. As the valve cylinder 610 is biased upward, it moves relative to the pin 715 carried by the valve sleeve 605 until the pin 715 comes into contact with a lower angled sidewall 735 of the pin track 705. The lower angled sidewall 735 continues to move along the pin 715 until the pin 715 sits in a second lower hooked portion 740. As the lower angled sidewall 735 of the pin track 705 moves along the pin 715, the valve cylinder 610 is again forced to rotate. When the drilling fluid is again flowed and the fluid pressure is again increased, the valve cylinder 610 biases downward and the track 705 moves along the pin 715 until the pin 715 comes into contact with an upper angled sidewall 745 of the track 705. The upper angled sidewall 745 of track 705 moves along the pin 715 until the pin 715 sits in a second upper hooked portion 750, which is shown by dotted lines. As the upper angled sidewall 745 of the pin track 705 moves with respect to pin 715, the valve cylinder 610 is forced to rotate still further within the valve sleeve 605. This rotation may cause the one or more apertures 730 to rotationally align with the one or more valve ports 620 carried by valve sleeve 605, allowing drilling fluid to flow into the lower annular chamber 345 and sliding the push sleeve 305 as described above.

In another embodiment, the valve cylinder 610 may have no apertures 730 or may have one or more apertures 730 which require both rotational and longitudinal displacement of valve cylinder 610 to open flow to one or more valve ports 620, and may be configured so that every other upper (or lower, as desired) hooked portion is configured to allow the valve cylinder 610, guided by engagement of pin track 705 with pin 715, to travel to a higher (or lower) respective position (as oriented in use) than the respective position allowed by the intermediate upper (or lower) hooked portions. For example, the second upper hooked portion 750 may be located at a respectively higher location than the first upper hooked portion 725, permitting greater longitudinal displacement of valve cylinder 610 with respect to valve sleeve 605, and permitting communication of one or more valve ports 620 with the interior of valve cylinder 610 when valve cylinder 610 is either at its higher or lower position, as desired. In other embodiments, as shown in FIG. 7, the second upper hooked portion 750 may be replaced by an elongated slotted portion 755. In either embodiment, the valve cylinder 610 can travel to a significantly more extended longitudinal location along valve sleeve 605 when a selected portion of pin track 705 is engaged with pin 715. In such embodiments, instead of aligning an aperture with the valve port 620, the valve cylinder 610 can be displaced downward by the flowing drilling fluid, or upward by spring 615, a sufficient longitudinal distance to expose the one or more valve ports 620.

It will be apparent that the valve 340 as embodied according to any of the various embodiments described above may be opened and closed repeatedly by simply reducing the flow rate of the drilling fluid and again increasing the flow rate of the drilling fluid to cause the valve cylinder 610 to bias upward and downward, resulting in the rotational and axial displacement described above due to the pin and track arrangement. By way of example and not limitation, the valve 340 embodied as described above may be configured with a bore size and spring force so that a flow rate of about 400 gpm (about 1,514 lpm) or higher may be sufficient to adequately bias the valve cylinder 610 downward against the spring 615, while a flow rate of about 100 gpm (about 378 lpm) or lower may be sufficient to allow the spring 615 to bias the valve cylinder 610 upward.

In still another embodiment of the mechanically operated valve 340, the valve cylinder 610 may comprise an inner diameter configuration substantially similar to the valve cylinder 610 shown in FIG. 6, and may also comprise a substantially cylindrical outer surface configured to abut against an inner sidewall of the valve sleeve 605. However, no pin and track arrangement is employed. Such embodiments are configured to inhibit drilling fluid flow into the valve port 620 by simply covering the valve port 620 whenever the pressure of the drilling fluid is insufficient to axially displace the valve cylinder 610 against the force of the spring 615 an adequate distance to expose the valve port 620. To open this embodiment of the valve 340, the drilling fluid flow rate is increased to sufficiently displace the valve cylinder 610 so the valve port 620 is exposed and drilling fluid can flow through valve port 620 into, and pressurize, the lower annular chamber 345. Similar to the embodiments of the valve 340 described previously, the valve cylinder 610 may be opened and closed repeatedly by simply increasing and decreasing the flow rate of the drilling fluid.

Figure 8:
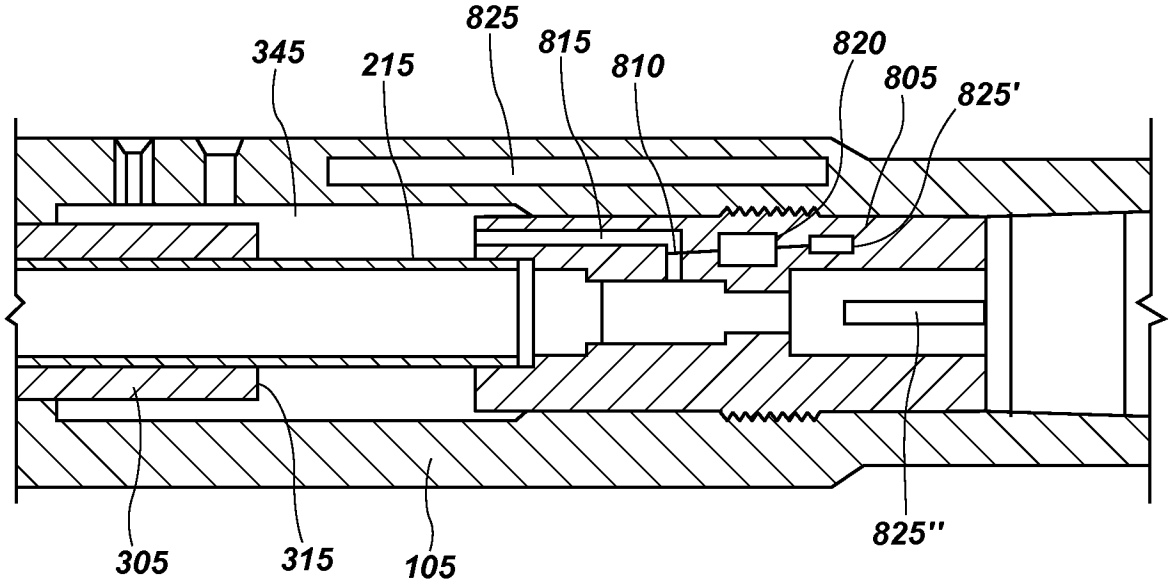
FIG. 8 shows an enlarged cross-sectional view of a valve according to at least one embodiment for an electronically controlled valve.

FIG. 8 illustrates an embodiment of the expandable apparatus 100 comprising an electronically operated valve 340'. In various embodiments, the electronically operated valve 340' comprises a valve sleeve 805 comprising at least one valve 810 associated with a valve port 815 in communication with the lower annular chamber 345. The valve 810 is controllably opened and closed by a drive device 820. By way of example and not limitation, the drive device 820 may comprise a solenoid, an electric motor such as a servo motor, or any other known device suitable for controlling the orientation or location of the valve 810. In order to reduce power consumption, valve 810 associated with valve port 815 may comprise, for example, a small pilot valve which is selectively caused by drive device 820 to direct drilling fluid pressure through a pilot port to open another larger valve 815 which may be, for example a spring-biased valve, to permit drilling fluid flow into lower annular chamber 345 through larger valve port 815. The drive device 820 is operably coupled to a controller 825. The controller 825 may be positioned in any location where it can readily control the operation of the actuation device 820. For example, FIG. 8 shows three non-limiting embodiments of the controller 825, such as controller 825 configured to be positioned in a sidewall of the tubular body 105, controller 825' configured to be positioned within the valve sleeve 805, and controller 825" comprising a probe configuration to be positioned in the fluid passageway 205 adjacent to the valve sleeve 805. As used herein, reference to "the controller 825" is intended to refer to any of the above described embodiments including controllers 825, 825' and 825". Of course, components of the controller may be distributed among multiple locations and operably coupled.

The controller 825 may comprise processing circuitry configured to obtain data, process data, send data, and combinations thereof. The processing circuitry may also control data access and storage, issue commands, and control other desired operations. The controller 825 may further include storage media coupled to the processing circuitry and configured to store executable code or instructions (e.g., software, firmware, or combinations thereof), electronic data, databases or other digital information and may include processor-usable media. The controller 825 may include a battery for providing electrical power to the various components thereof, including the drive device 820. The controller 825 may also include, or be operably coupled to, an apparatus state detection device coupled to the processing circuitry and configured to detect one or more selected states of the expandable apparatus 100. For example, the apparatus state detection device may comprise one or more accelerometers or magnetometers 850 configured to detect a rotational speed of the expandable apparatus 100, a rotational direction of the expandable apparatus 100, or a combination of rotational speed and rotational direction.

The controller 825 may include programming configured to change the state of the valve 810 in response to some predetermined command signal provided by an operator. One non-limiting example of a command signal may comprise rotating the expandable apparatus 100 at a given rotational speed for a determined period of time, stopping the rotation and repeating the rotation and stopping for some given number of times (e.g., three times). Such a combination of rotation and stopping is detected by one or more accelerometers 850 which may, for example, if not incorporated in a controller 825, may be placed in a separate compartment of tubular body 105. The controller 825 operates to open or close the valve 810 based on the detection of this combination by the accelerometers. Another non-limiting example of a command signal may comprise rotating the expandable apparatus 100 at a rate of 60 rpm for 60 seconds, followed by a rate of 90 rpm for 90 seconds. One of ordinary skill in the art will recognize that a plurality of possible signals and signal types may be employed for activating the controller 825.

As another approach to command signal detection, a removable module including accelerometers 850 and, optionally, other sensors such as magnetometers, may be placed in alignment with fluid passageway 205 at the upper end 115 or the lower end 110 of expandable apparatus 100 (see FIG. 3), or in the wall or a bore of a sub secured to the upper end or lower end. Signals from such a module may be transmitted through wiring in the wall of tubular body 105 of expandable apparatus, or by so-called "short hop" wireless telemetry to a receiver associated in controller 825. Such a module suitable for disposition in a tool bore may be configured in the form of an annular DATABIT™ module, offered by Baker Hughes Incorporated. The structure and operation of one embodiment of such a module is described in U.S. Pat. No. 7,604,072, issued Oct. 20, 2009 and assigned to the assignee of the present disclosure. The disclosure of the foregoing patent is hereby incorporated herein in its entirety by reference.

As a result of each of the foregoing embodiments and equivalents thereof, expandable apparatuses of various embodiments of the disclosure may be expanded and contracted by an operator an unlimited number of times.

Figure 9:
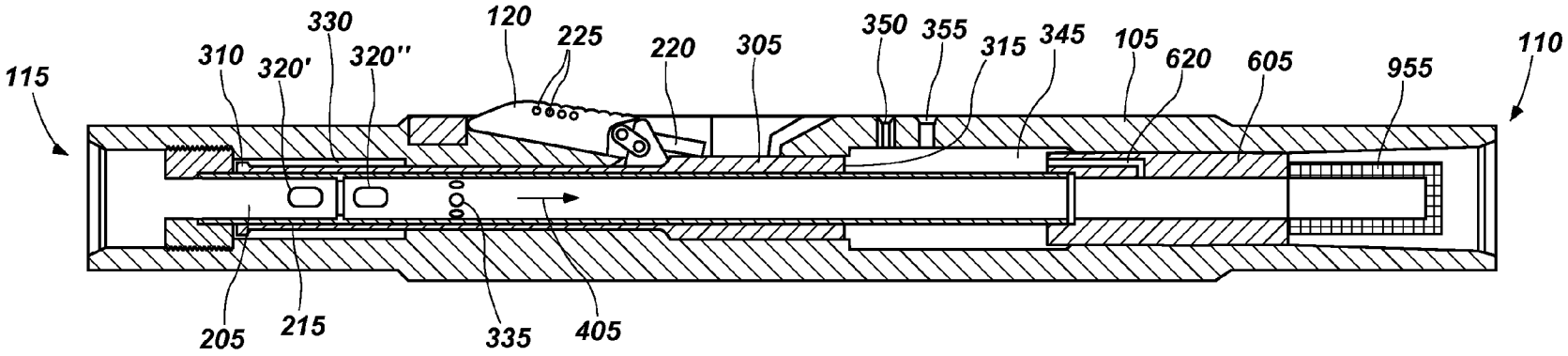
FIG. 9 shows a longitudinal cross-sectional view of a further embodiment of the expandable apparatus configured to employ a trap sleeve and a flow restricting element.

FIG. 9 illustrates another embodiment of an expandable apparatus 100. In the embodiment disclosed, the one or more valve ports 620 in the valve sleeve 605 are left unobstructed, allowing fluid to flow into the lower annular chamber 345. The fluid flowing into the lower annular chamber 345 may exert a force on the lower surface 315 of the push sleeve 305, causing the push sleeve 305 to slide upward and extending the blades 120, 125, 130 (as illustrated by blade 120), as discussed previously. A screen catcher 955 is coupled to the valve sleeve 605 for catching discarded traps 905 (FIG. 10) and balls 950 (FIG. 12) as discussed in further detail below. The screen catcher 955 is configured to catch the traps 905 and balls 950 while having little to no effect on the flow of the drilling fluid therethrough. In some embodiments, the screen catcher 955 may include a removable cap (not shown) for removing traps 905 and balls 950 from the screen catcher 955 when the expandable apparatus 100 is no longer in use.

Figure 10:
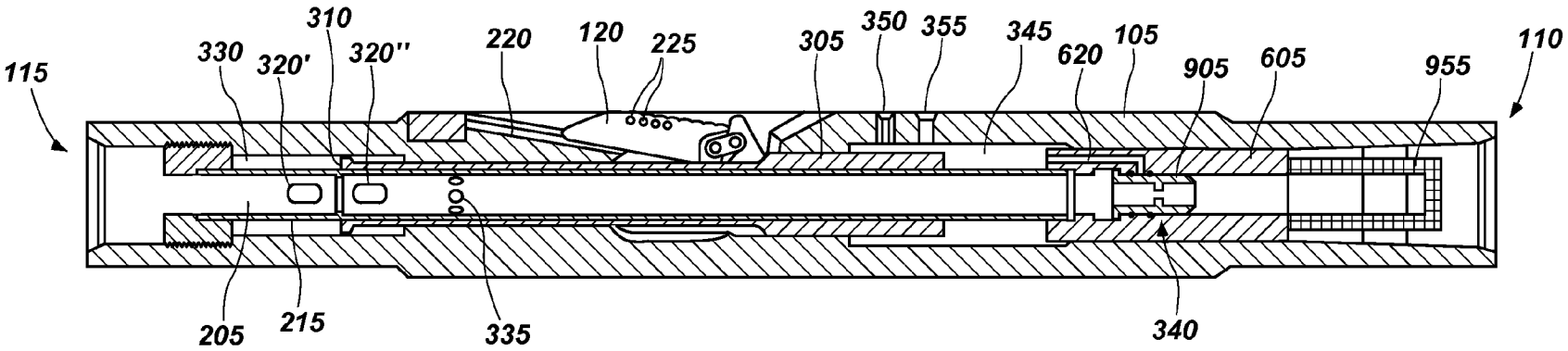
FIG. 10 shows an enlarged cross-sectional view of the lower end of the expandable apparatus of FIG. 9.
Figure 11:
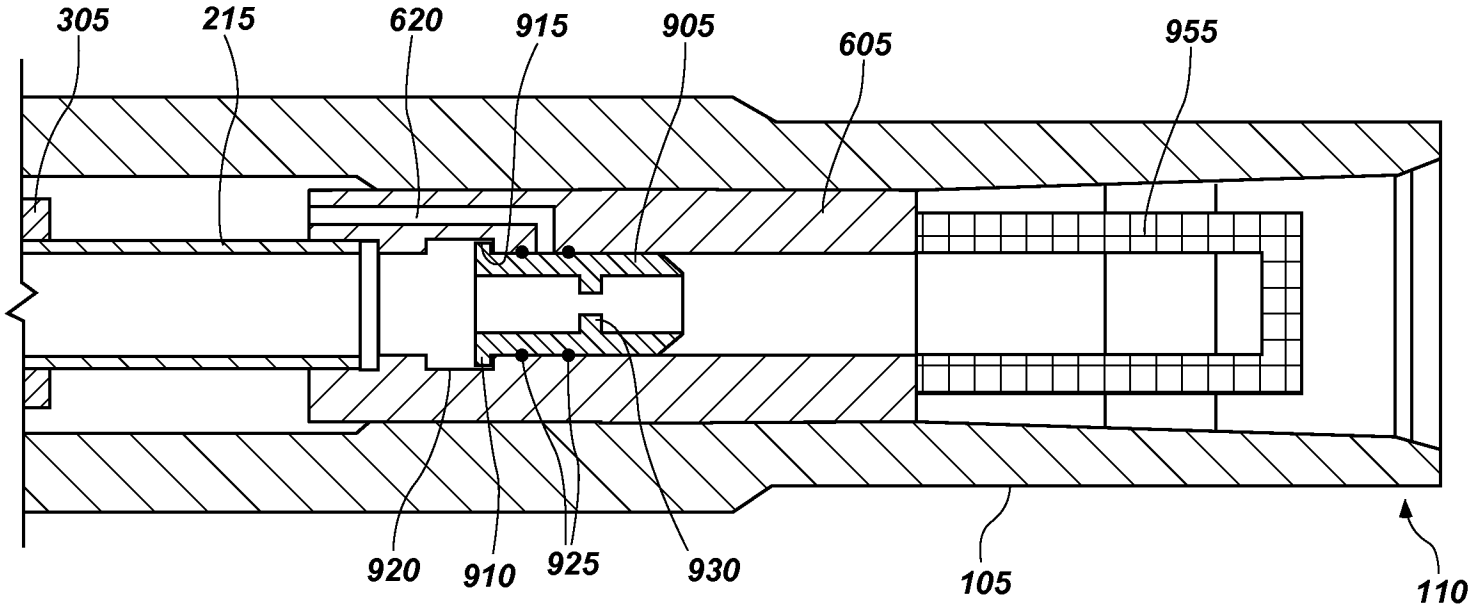
FIG. 11 shows a longitudinal cross-sectional view of the expandable apparatus of FIG. 9 with a trap sleeve in place.

As shown in FIG. 10, when it is desired to retract the blades 120, 125, 130, drilling fluid flow is momentarily ceased, if required, and a trap 905 is dropped into the drill string and pumping of drilling fluid resumed. The trap 905 moves down the drill string and through the expandable reamer apparatus 100 toward the lower end 110. After a short time, the trap 905 is latched in the valve sleeve 605 and obstructs the at least one fluid port 620. FIG. 11 is an enlarged cross-sectional view of the lower end 110 of the expandable apparatus 100 shown in FIG. 10. As shown in FIG. 11, complementary positioning features may be provided in the trap 905 and the valve sleeve 605 to facilitate proper relative positioning therebetween when the trap 905 travels through the valve sleeve 605. In some embodiments, as shown in FIG. 11, the trap 905 may comprise a male connection feature, such as at least one protrusion 910 shaped as a radially extended flange extending circumferentially at least partially around a longitudinal axis of the trap 905. In some embodiments, the trap 905 may comprise a solid tubular cylinder, or the tubular cylinder may be partially cut along a longitudinal axis of the trap at circumferential intervals to form individual, finger-like extensions each with a protrusion thereon. The valve sleeve 605 may comprise a female connection feature, such as an annular receptacle or recess 915 formed in a surface 920 of the valve sleeve 605. The recess 915 may be a complementary size and shape to that of the at least one protrusion 910 and may be configured to receive the at least one protrusion 910 therein. The at least one protrusion 910 may comprise a malleable material, such as, for example brass, or may be resiliently biased outwardly. When inserting the trap 910 into the drill string, the at least one protrusion 910 may be retracted in toward the center of the fluid passageway 205, or be resilient biased to easily contract, so that trap 905 can pass through the fluid passageway 205. Once the protrusion 910 reaches the recess 915, the at least one protrusion 910 will extend laterally outward into the recess 915 and latch the trap 905 into a desired location in the valve sleeve 605. Fluid seals 925, such as an o-ring, may be coupled to the trap 905 to further obstruct fluid from entering valve port 620. The trap 905 may also include at least one protrusion 912, which may be of annular configuration, extending into the fluid passageway 205, which functions as a ball seat 930 and which will be discussed in further detail below.

Referring back to FIG. 10, with the trap sleeve 905 latched in valve sleeve 605, the drilling fluid will continue to flow through the upper fluid port 320' into the upper annular chamber 330 but the fluid will be obstructed from flowing through the at least one valve port 620 into the lower annular chamber 345. When the at least valve port 620 is obstructed by the trap 905, a volume of drilling fluid will remain in the lower annular chamber 345. The drilling fluid escapes from the lower annular chamber 345 through the pressure nozzle 350, as previously discussed. As the fluid in the lower annular chamber 345 escapes, the force on the upper surface 310 of the push sleeve 305 caused by the fluid flow through the fluid passageway 205 into the upper annular chamber 330 will exceed the force on the lower surface 315 of the push sleeve 305, driving the push sleeve 305 to the lower end 190 of the expandable apparatus 100. When the push sleeve 305 is driven to the axially lower limit of its path of travel, the blades 120, 125, 130 are fully retracted.

Figure 12:
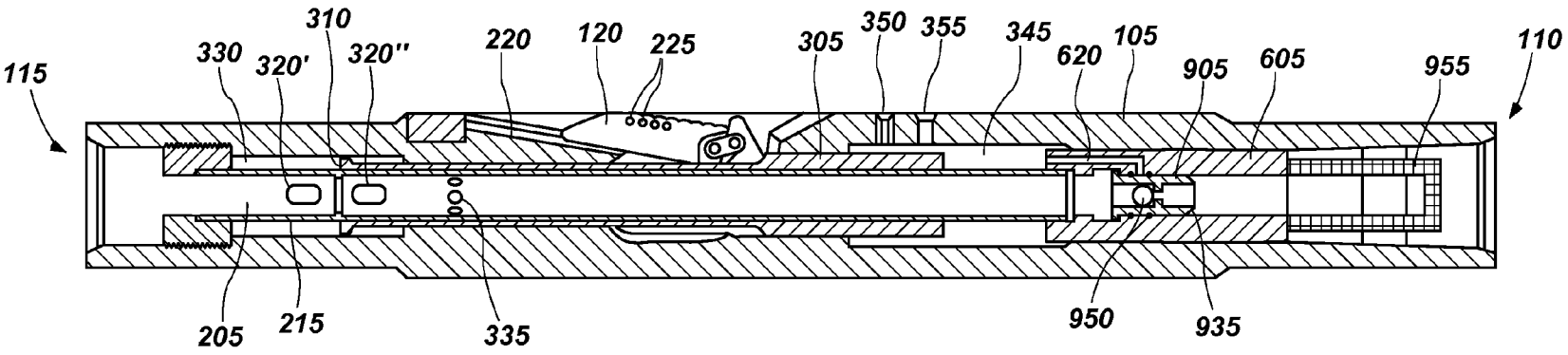
FIG. 12 shows a longitudinal cross-sectional view of the expandable apparatus of FIG. 9 with a trap sleeve in place and a flow restriction element retained in the trap sleeve.
Figure 13:
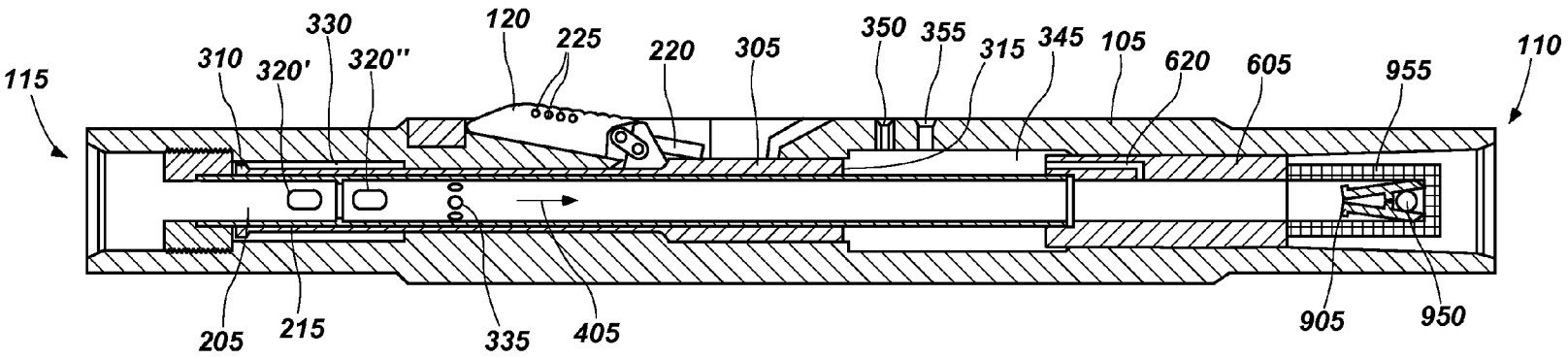
FIG. 13 shows a longitudinal cross-sectional view of the expandable apparatus of FIG. 9 with a trap sleeve and a flow restriction element released and retained in a screen catcher.

As shown in FIGS. 12 and 13, when it is desired to trigger the expandable apparatus 100 to re-extend the blades 120, 125, 130, drilling fluid flow may be momentarily ceased, if required, and a ball 905 or other flow restricting element, is dropped into the drill string and pumping of drilling fluid resumed. The ball 950 moves toward the lower end 110 of the expandable reamer apparatus 100 under the influence of gravity, the flow of drilling fluid, or both, until the ball 950 reaches the ball seat 930 where the ball 950 becomes trapped. The ball 950 stops drilling fluid flow and causes pressure to build above it in the drill string. As the pressure builds, the protrusion or protrusions 910 of trap 905 may either shear off, or the protrusions 910 of the trap 905 may be deformed or biased radially inwardly such that the protrusion or protrusions 910 are retracted inward away from the valve sleeve 605. With the protrusions 910 sheared, deformed, or biased inwardly, the metal trap 905 and the ball 950 will be expelled from the valve sleeve 605 into the screen catcher 955 as shown in FIG. 13. With the trap 905 and the ball 950 in the screen catcher 955, the valve port 620 is again unobstructed, and fluid may flow through the valve port 620 into the lower annular chamber 345 and cause the blades 120, 125, 130 to extend as previously described regarding FIG. 9. The process of retracting and extending the blades 120, 125, 130 described in FIGS. 9 through 13 may be repeated as desired until the screen catcher 955 cannot accept additional discarded traps 905 and balls 950.

Although the foregoing disclosure illustrates embodiments of an expandable apparatus comprising an expandable reamer apparatus, the disclosure is not so limited. For example, in accordance with other embodiments of the disclosure, the expandable apparatus may comprise an expandable stabilizer, wherein the one or more expandable features may comprise stabilizer blocks (e.g., the blades 120, 125, 130 may be replaced with one or more stabilizer blocks).

Figure 14:
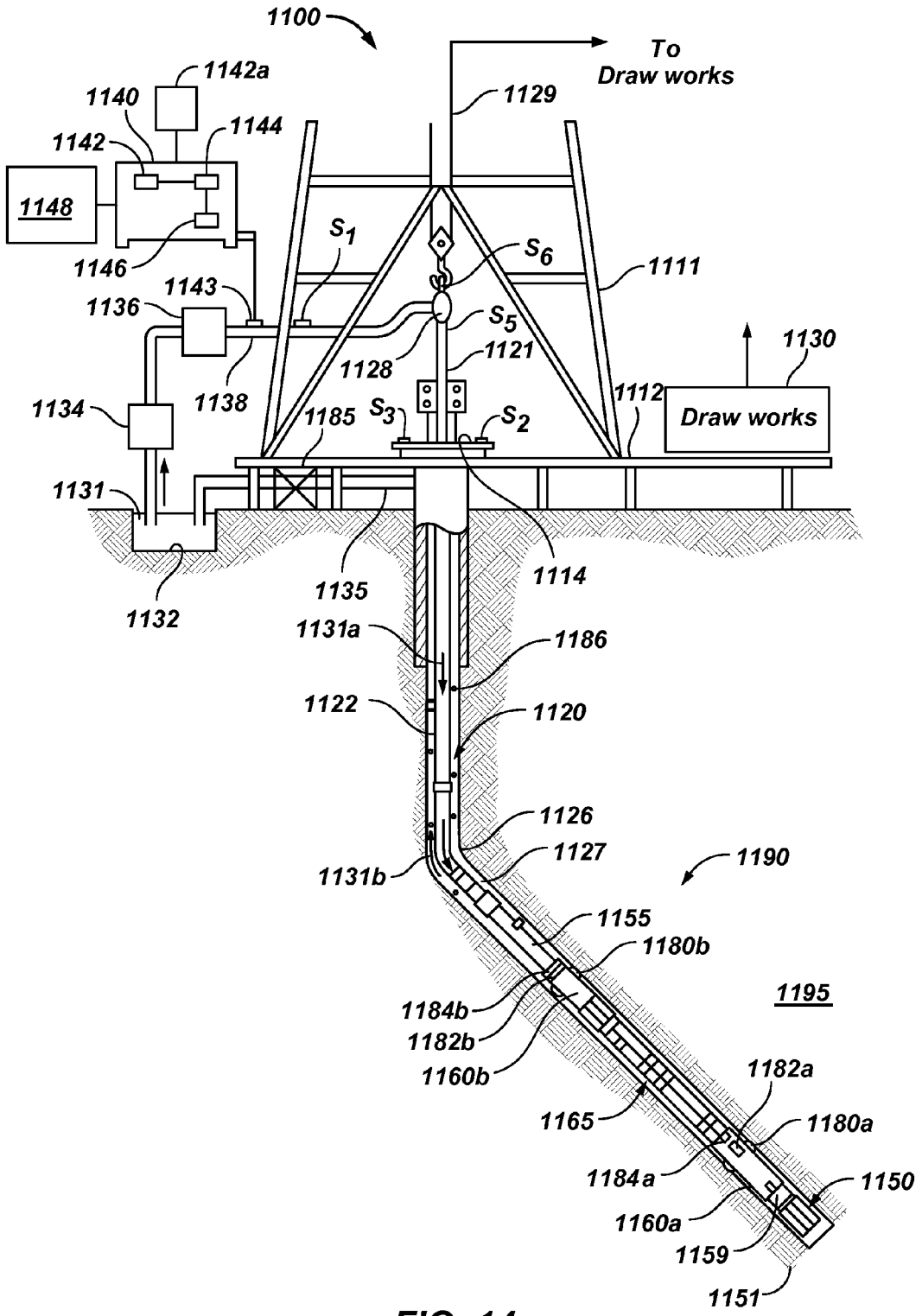
FIG. 14 is an elevation view of a drilling system including an actuation device, according to an embodiment of the disclosure.

FIG. 14 is a schematic diagram of an embodiment of a drilling system 1100 that includes a drill string having a drilling assembly attached to its bottom end that includes a steering unit according to one embodiment of the disclosure. FIG. 14 shows a drill string 1120 that includes a drilling assembly or bottom hole assembly ("BHA") 1190 conveyed in a borehole 1126. The drilling system 1100 includes a conventional derrick 1111 erected on a platform or floor 1112 which supports a rotary table 1114 that is rotated by a prime mover, such as an electric motor (not shown), at a desired rotational speed. A tubular string (such as jointed drill pipe) 1122, having the drilling assembly 1190 attached at its bottom end extends from the surface to a bottom 1151 of the borehole 1126. A drill bit 1150, attached to drilling assembly 1190, disintegrates the geological formations when it is rotated to drill the borehole 1126. The drill string 1120 is coupled to a draw works 1130 via a Kelly joint 1121, swivel 1128 and line 1129 through a pulley. Draw works 1130 is operated to control the weight on bit ("WOB"). The drill string 1120 may be rotated by a top drive (not shown) instead of by the prime mover and the rotary table 1114. The operation of the draw works 1130 is known in the art and is thus not described in detail herein.

In one aspect of operation, a suitable drilling fluid 1131 (also referred to as "mud") from a source 1132 thereof, such as a mud pit, is circulated under pressure through the drill string 1120 by a mud pump 1134. The drilling fluid 1131 passes from the mud pump 1134 into the drill string 1120 via a de-surger 1136 and a fluid line 1138. The drilling fluid 1131*a* from the drilling tubular discharges at the borehole bottom 1151 through openings in the drill bit 1150. The returning drilling fluid 1131*b* circulates uphole through an annular space 1127 between the drill string 1120 and the borehole 1126 and returns to the mud pit 1132 via a return line 1135 and drill cuttings 1186 screen 1185 that removes drill cuttings 1186 from the returning drilling fluid 1131*b*. A sensor $S_1$ in line 1138 provides information about the fluid flow rate. A surface torque sensor $S_2$ and a sensor $S_3$ associated with the drill string 1120 provide information about the torque and the rotational speed of the drill string 1120. Rate of penetration of the drill string 1120 may be determined from the sensor $S_5$, while the sensor $S_6$ may provide the hook load of the drill string 1120.

In some applications, the drill bit 1150 is rotated by rotating the drill pipe 1122. However, in other applications, a downhole motor 1155 such as, for example, a Moineau-type so-called "mud" motor or a turbine motor disposed in the drilling assembly 1190 may rotate the drill bit 1150. In embodiments, the rotation of the drill string 1120 may be selectively powered by one or both of surface equipment and the downhole motor 1155. The rate of penetration ("ROP") for a given drill bit and BHA largely depends on the WOB, or other thrust force, applied to the drill bit 1150 and its rotational speed.

With continued reference to FIG. 14, a surface control unit or controller 1140 receives signals from the downhole sensors and devices via a sensor 1143 placed in the fluid line 1138 and signals from sensors $S_1$-$S_6$ and other sensors used in the system 1100 and processes such signals according to programmed instructions provided from a program to the surface control unit 1140. The surface control unit 1140 displays desired drilling parameters and other information on a display/monitor 1142*a* that is utilized by an operator to control the drilling operations. The surface control unit 1140 may be a computer-based unit that may include a processor 1142 (such as a microprocessor), a storage device 1144, such as a solid-state memory, tape or hard disc, and one or more computer programs 1146 in the storage device 1144 that are accessible to the processor 1142 for executing instructions contained in such programs. The surface control unit 1140 may further communicate with at least one remote control unit 1148 located at another surface location. The surface control unit 1140 may process data relating to the drilling operations, data from the sensors and devices on the surface, data received from downhole and may control one or more operations of the downhole and surface devices.

The drilling assembly 1190 also contains formation evaluation sensors or devices (also referred to as measurement-while-drilling, "MWD," or logging-while-drilling, "LWD,"

sensors) determining resistivity, density, porosity, permeability, acoustic properties, nuclear-magnetic resonance properties, corrosive properties of the fluids or formation downhole, salt or saline content, and other selected properties of a formation 1195 surrounding the drilling assembly 1190. Such sensors are generally known in the art and for convenience are generally denoted herein by numeral 1165. The drilling assembly 1190 may further include a variety of other sensors and communication devices 1159 for controlling and/or determining one or more functions and properties of the drilling assembly (such as velocity, vibration, bending moment, acceleration, oscillations, whirl, stick-slip, etc.) and drilling operating parameters, such as weight-on-bit, fluid flow rate, pressure, temperature, rate of penetration, azimuth, tool face, drill bit rotation, etc.

Still referring to FIG. 14, the drill string 1120 further includes one or more downhole tools 1160*a* and 1160*b*. In an aspect, the tool 1160*a* is located in the BHA 1190, and includes at least one reamer 1180*a* to enlarge the diameter of wellbore 1126 as the BHA 1190 penetrates the formation 1195. In addition, the tool 1160*b* may be positioned uphole of and coupled to the BHA 1190, wherein the tool 1160*b* includes a reamer 1180*b*. In one embodiment, each reamer 1180*a*, 1180*b*, which may comprise one or more circumferentially spaced blades or other elements carrying cutting structures thereon, is an expandable reamer that is selectively extended and retracted from the tool 1160*a*, 1160*b* to engage and disengage the wellbore wall. The reamers 1180*a*, 1180*b* may also stabilize the drilling assembly 1190 during downhole operations. In an aspect, the actuation or movement of the reamers 1180*a*, 1180*b* is powered by an actuation device 1182*a*, 1182*b*, respectively. The actuation devices 1182*a*, 1182*b* are in turn controlled by controllers 1184*a*, 1184*b* positioned in or coupled to the actuation devices 1182*a*, 1182*b*. The controllers 1184*a*, 1184*b* may operate independently or may be in communication with other controllers, such as the surface controller 1140. In one aspect, the surface controller 1140 remotely controls the actuation of the reamers 1180*a*, 1180*b* via downhole controllers 1184*a*, 1184*b*, respectively. The controllers 1184*a*, 1184*b* may be a computer-based unit that may include a processor, a storage device, such as a solid-state memory, tape or hard disc, and one or more computer programs in the storage device that are accessible to the processor for executing instructions contained in such programs. It should be noted that the depicted reamers 1180*a*, 1180*b* are only one example of a tool or apparatus that may be actuated or powered by the actuation devices 1182*a*, 1182*b*, which are described in detail below. In some embodiments, the drilling system 1100 may utilize the actuation devices 1182*a*, 1182*b* to actuate one or more tools, such as reamers, stabilizers with movable pads, steering pads and/or drilling bits with movable blades, by selectively flowing of a fluid. Accordingly, the actuation devices 1182*a*, 1182*b* provide actuation to one or more downhole apparatus or tools 1160*a*, 1160*b*, wherein the device is controlled remotely, at the surface, or locally by controllers 1184*a*, 1184*b*.

Figure 15A:
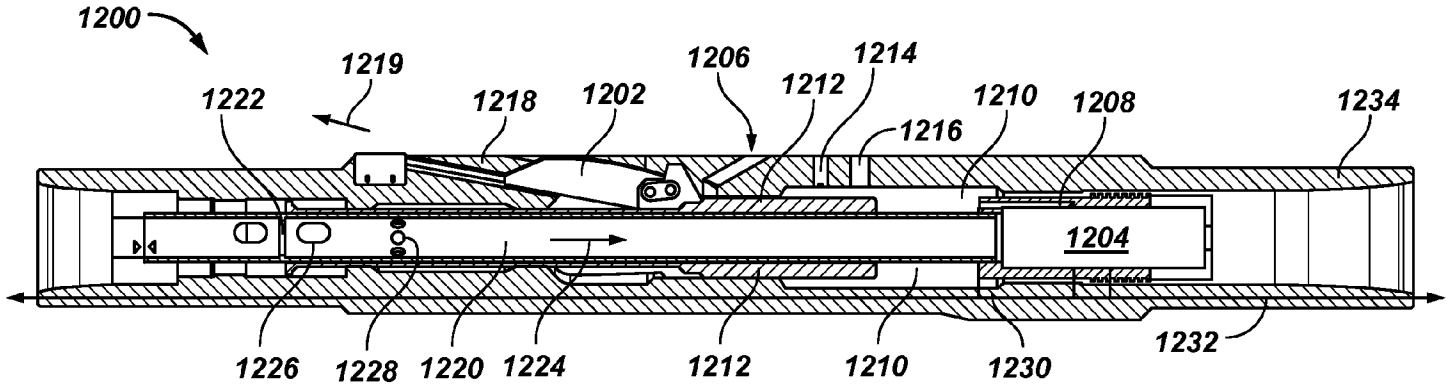
FIGS. 15A and 15B are sectional side views of an embodiment of a portion of a drill string, a tool and an actuation device, wherein the tool is depicted in two positions, according to an embodiment of the disclosure.
Figure 15B:
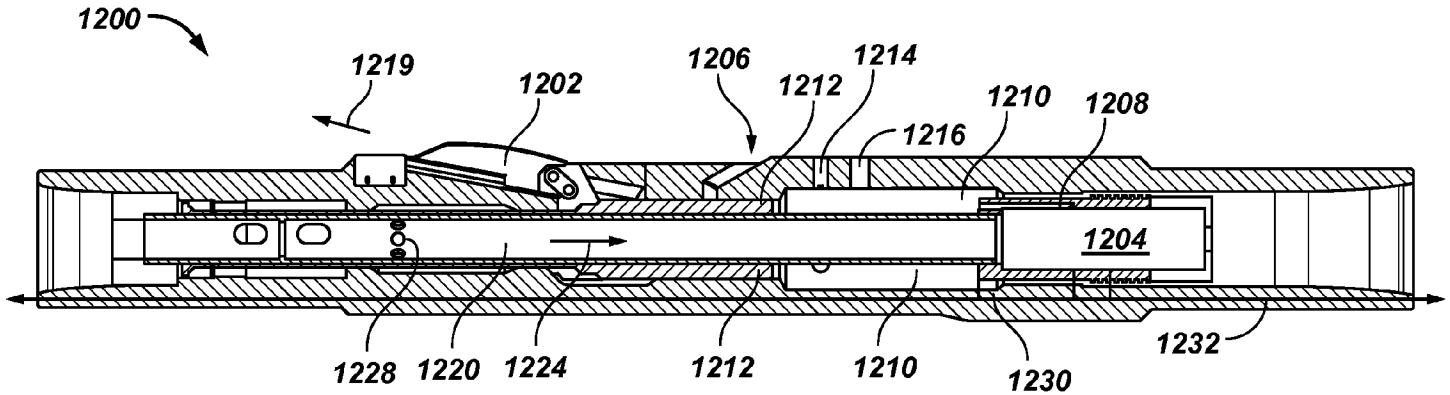
Figure 16A:
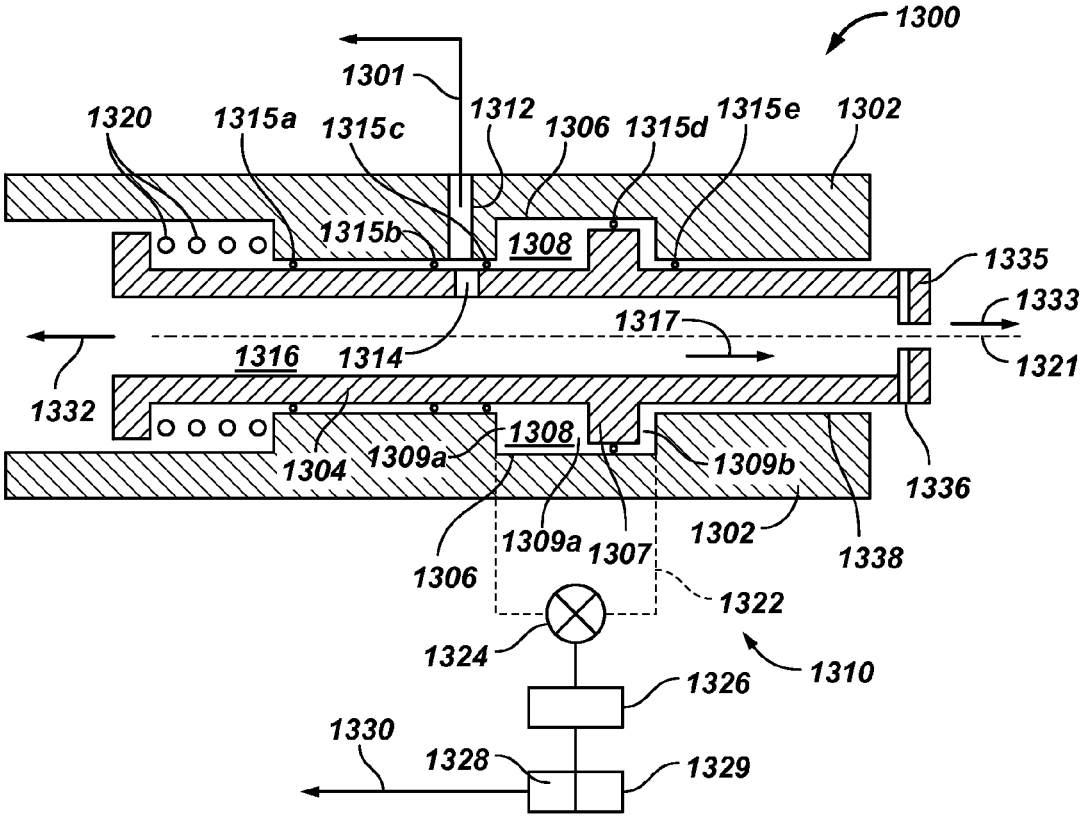
FIGS. 16A and 16B are sectional schematic views of an actuation device in two states or positions, according to an embodiment of the disclosure.
Figure 16B:
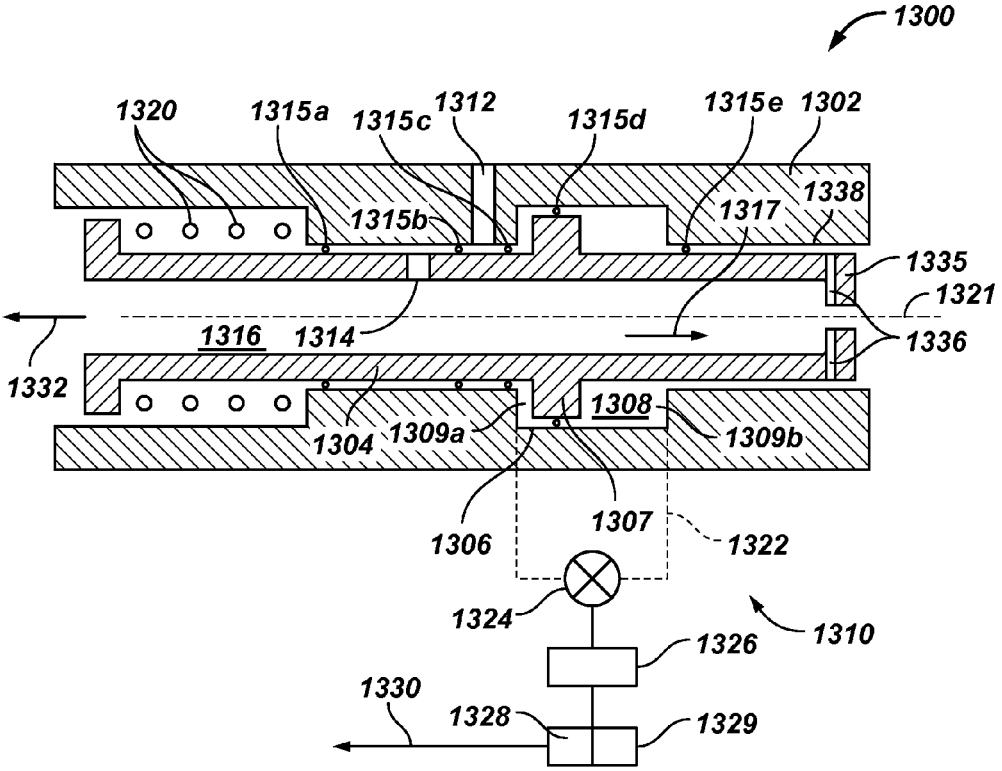

FIGS. 15A and 15B are sectional side views of an embodiment a portion of a drill string, a tool and an actuation device, wherein the tool is depicted in two positions. FIG. 15A shows a tool 1200 with a reamer blade 1202 in a retracted, inactive or closed position. FIG. 2B shows the tool 1200 with reamer blade 1202 in an extended or active position. The tool 1200 includes an actuation device 1204 configured to change positions, states or operational modes of the reamer 1202. The depicted tool 1200 shows a single reamer blade 1202 and actuation device 1204, however, the concepts discussed herein may apply to embodiments with a plurality of tools 1200, reamers 1202 and/or actuation devices 1204. For example, a single actuation device 1204 can actuate a plurality of reamer blades 1202 in a tool 1200, wherein the actuation device 1204 controls fluid flow to the move the reamer blades 1202. As shown, the actuation device 1204 is schematically depicted as a functional block; however, greater detail is shown in FIGS. 16A and 16B. In an aspect, the reamer blade 1202 includes or is coupled to an actuation assembly 1206, wherein the actuation device 1204 and the actuation assembly 1206 causes movement of reamer blade 1202. Line 1208 provides fluid communication between actuation device 1204 and the actuation assembly 1206. The actuation assembly 1206 includes a chamber 1210, sliding sleeve 1212, bleed nozzle 1214 and check valve 1216. The sliding sleeve 1212 (or annular piston) is coupled to the reamer blade 1202, wherein the reamer blade 1202 may extend and retract along actuation track 1218. In an aspect, the reamer blade 1202 includes abrasive members, such as cutters configured to remove formation material from a wellbore wall, thereby enlarging the diameter of the wellbore. The reamer blade 1202 may extend to contact a wellbore wall as shown by arrow 1219 and in FIG. 15B.

Still referring to FIGS. 15A and 15B, in an aspect, drilling fluid 1224 flows through a sleeve 1220, wherein the sleeve 1220 includes a flow orifice 1222, flow bypass port 1226, and nozzle ports 1228. In one aspect, the actuation device 1204 is electronically coupled to a controller located uphole via a line 1230. As described below, the actuation device 1204 may include a controller configured for local control of the device. Further, the actuation device 1204 may be coupled to other devices, sensors and/or controllers downhole, as shown by line 1232. For example, tool end 1234 may be coupled to a BHA, wherein the line 1232 communicates with devices and sensors located in the BHA. As depicted, the line 1230 may be coupled to sensors that enable surface control of the actuation device 1204 via signals generated uphole that communicate commands including the desired position of the reamer 1202. In one aspect, the line 1232 is coupled to accelerometers that detect patterns in the drill string rotation rate, or RPM, wherein the pattern is decoded for commands to control one or more actuation device 1204. Further, an operator may use the line 1230 to alter the position based on a condition, such as drilling a deviated wellbore at a selected angle. For example, a signal from the surface controller may extend the reamer blade 1202, as shown in FIG. 15B, during drilling of a deviated wellbore at an angle of 15 degrees, wherein the extended reamer blade 1202 provides stability while also increasing the wellbore diameter. It should be noted that FIGS. 15A and 15B illustrate non-limiting examples of a tool or device (1200, 1202) that may be controlled by fluid flow from the actuation device 1204, which is also described in detail with reference to FIGS. 3A and 3B.

FIGS. 16A and 16B are schematic sectional side views of an embodiment of an actuation device 1300 in two positions. FIG. 16A illustrates the actuation device 1300 in an active position, providing fluid flow 1301 to actuate a downhole tool, as described in FIGS. 15A and 15B. FIG. 16B shows the actuation device 1300 in a closed position, where there is no fluid flow to actuate the tool. In an aspect, the actuation device 1300 includes a housing 1302 and a piston 1304 located in the housing 1302. The housing 1302 includes a chamber 1306 where an annular member 1307, extending radially from the piston 1304, is positioned. In an aspect, the housing 1302 contains a hydraulic fluid 1308, such as a substantially non-compressible oil. The chamber 1306 may be divided into two chambers, 1309*a* and 1309*b*, by the annular member 1307. Further, the fluid 1308 may be transferred between the chambers 1309*a* and 1309*b* by a flow control device 1310 (or locking device), enabling movement of the annular member 1307 within chamber 1306. In an aspect, the housing 1302 includes a port 1312 that provides fluid communication with the line 1208 (FIGS. 15A and 15B). When the piston 1304 is in a selected active axial position, as shown in FIG. 16A, a port 1314 enables fluid communication from bore 1316 to port 1312 and line 1208. In one aspect, a drilling fluid is pumped by surface pumps causing the fluid to flow downhole, shown by arrow 1317. Accordingly, as depicted in FIG. 16A, the actuation device 1300 is in an active position where drilling fluid flows from the bore 1316 through ports 1314, 1312 and into a supply line 1208, as shown by arrow 1301. In an aspect, the actuation device 1300 includes a plurality of seals, such as ring seals 1315*a*, 1315*b*, 1315*c*, 1315*d* and 1315*e*, where the seals restrict and enable fluid flow through selected portions of the device 1300. As depicted, the flow control device 1310 (also referred to as a "locking device") uses enabling or stopping a flow of fluid to selectively "lock" the piston 1304 in a selected axial position. It should be understood that any suitable locking device may be used to control axial movement by locking and unlocking the position of annular member 1307 within chamber 1306. In other aspects, the locking device 1310 may comprise any suitable mechanical, hydraulic or electric components, such as a solenoid or a biased collet.

With continued reference to FIGS. 16A and 16B, a biasing member 1320, such as a spring, is operably positioned between the housing 1302 and a flange of piston 1304. The biasing member 1320 may be axially compressed and extended, thereby providing an axial force as the piston 1304 moves along axis 1321. In an aspect, the flow control device 1310 is used to control axial movement of the piston 1304 within the housing 1302. As depicted, the flow control device 1310 is a closed loop hydraulic system that includes a hydraulic line 1322, a valve 1324, a processor 1326 and a memory device 1328, wherein one or more software programs 1329 are configured to run on the processor 1326 and memory device 1328. The processor 1326 may be a microprocessor configured to control the opening and closing of valve 1324, which is in fluid communication with chambers 1309*a*, 1309*b*. In an embodiment, the processor 1326 and memory 1328 are connected by a line 1330 to other devices uphole, such as a controller or sensors in the drill string. In other embodiments, the flow control device 1310 operates independently or locally, based on the control of the processor 1326, memory 1328, software programs 1329 and additional inputs, such as sensed downhole parameters and patterns within sensed parameters. In another aspect, the flow control device 1310 and actuation device 1300 may be controlled by a surface controller, where signals are sent downhole by a communication line, such as line 1330. In another aspect, a sensor, such as an accelerometer, may sense a pattern in mud pulses, wherein the pattern communicates a command message, such as one describing a desired position for the actuation device 1300. As depicted, the piston 1304 includes a nozzle 1335 with one or more bypass ports 1336, where the nozzle 1335 enables flow from the bore 316 downhole.

The operation of actuation device 1300, with reference to FIGS. 16A and 16B, is discussed in detail below. FIG. 16A shows the actuation device 1300 in an active position. The device 1300 moves to an active position when drilling fluid flowing downhole 1317 through the restriction provided by nozzle 1335 causes an axial force in the flow direction, pushing the piston 1304 axially 1333. In an embodiment, the fluid flow axial force is greater than the resisting spring force of biasing member 1320, thereby compressing the biasing member 1320 as the piston 1304 moves in direction 1333. In addition, the valve 1324 is opened to allow hydraulic fluid to flow from chamber 1309*b*, substantially filling chamber 1309*a*. This enables movement of annular member 1307 in chamber 1306, thereby enabling the piston 1304 to move axially 1333. Accordingly, as the valve 1324 is opened (or unlocked) the flow of drilling fluid downhole 1317, controlled uphole by mud pumps, provides an axial force to move piston 1304 to the active position. As the chamber 1309*a* is substantially full and chamber 1309*b* is substantially empty, the valve 1324 is closed or locked, thereby enabling the ports 1312 and 1314, which are aligned and provide a flow path, to be locked in an aligned arrangement. In the active position, the drilling fluid flows in a substantially unrestricted manner through the nozzle 1335 and bypass ports 1336, as flow from the bypass ports 1336 is not restricted by inner surface 1338. Accordingly, in the active position, the actuation device 1300 provides fluid flow 1301 to actuate one or more downhole tools, such as reamer 1202 shown in FIG. 15B.

As shown in FIG. 16B, the actuation device 1300 is in a closed position, where the piston 1304 has been moved axially 1332 by the flow control device 1310 and biasing member 1320, thereby stopping a flow of drilling fluid from the annulus 1316 through ports 1314 and 1312. To move actuation device 1300 to the closed position, the valve 1324 is opened to enable hydraulic fluid to flow from chamber 1309*a* to chamber 1309*b*, thereby unlocking the position of annular member 1307 within chamber 1306 and enabling the piston 1304 to move axially 1332. In addition, the flow of drilling fluid downhole 1317 is reduced or stopped to allow the force of biasing member 1320 to cause piston 1304 to move axially uphole 1332. Once the piston 1304 is in the desired closed position, where the ports 1312 and 1314 are not in fluid communication with each other, the valve 1324 is closed to lock the piston 1304 in place and preclude fluid communication through ports 1312 and 1314. In the closed position, the chamber 1309*a* is substantially empty and the chamber 1309*b* is substantially full. In addition, in the closed position of actuation device 1300, drilling fluid does not flow through the bypass ports 1336, which are restricted by surrounding inner surface 1338. Thus, the actuation device 1300 in a closed position shuts off fluid flow and corresponding actuation to one or more tools operationally coupled to the device, thereby keeping the tool, such as a reamer blade 1202 (FIG. 15A) in a neutral position. It should be noted that a difference in drilling fluid back pressure as it flows through actuation device 1300, due to the obstruction or non-obstruction of bypass ports 1336 and the lack or presence of fluid flow through ports 1312 and 1314, may be used by an operator at the surface to verify the operational mode of the apparatus in which actuation device 1300 is employed.

Referring back to FIG. 14, in an aspect, one or more downhole devices or tools, such as the reamers 1180*a*, 1180*b*, are controlled by and communicate with the surface via pattern recognition signals transmitted through the drill string. The signal patterns may be any suitable robust signal that allows communication between the surface drilling rig and the downhole tool, such as changes in drill string rotation rate (revolutions per minute or "RPM") or changes in mud pulse frequency. In an aspect, the sequence, rotation rate speed (RPM) and duration of the rotation is considered a pattern or pattern command that is detected downhole to control one or more downhole tools. For example, the drill string may be rotated by the drilling rig at 40 RPM for 10 seconds, followed by a rotation of 20 RPM for 30 seconds, where one or more sensors, such as accelerometers or other sensors, sense the drill string rotation speed and route such detected speeds and corresponding signals to a processor 1326 (FIGS. 16A and 16B). Another suitable rotational sequence is, for example, a three-signal pattern of 30 rpm for 30 seconds, then 60 rpm for 20 second, then 10 rpm for 60 seconds. The processor 1326 decodes the pattern of rotational speeds and durations by comparison to patterns stored in memory 1328 to determine the selected tool position sent from the surface and then the actuation device 1300 (FIGS. 16A and 16B) causes the tool to move to the desired position. In another aspect, a sequence of mud pulses of a varying parameter, such as duration, amplitude and/or frequency may provide a command pattern received by pressure sensors to control one or more downhole devices. In aspects, a plurality of downhole tools may be controlled by pattern commands, wherein a first pattern sequence triggers a first tool to position A and a second pattern sequence triggers a second tool to second position B. In the example, the first and second patterns may be RPM and/or pulse patterns that communicate specific commands to two separate tools downhole. Thus, RPM pattern sequences and/or pulse pattern sequences in combination with a tool and actuation device, such as the actuation device described above, and sensors enable communication with and improved control of one or more downhole devices.

As yet another actuation device command signal alternative, rather than using drill string rotation or mud pulses, a series of different drilling fluid flow rates and durations may be used as patterns for detection by a downhole flow meter, which may be used to provide a pattern of signals to processor 1326. One example flow rate signal pattern may be characterized as 50 gpm for 20 seconds, then 100 gpm for 30 seconds, then zero flow for 30 seconds.

A further actuation device command signal alternative using flow detection by a flow meter may employ engagement of a drilling fluid (mud) pump for 30 seconds, followed by shut off for 30 seconds, followed by pump engagement for 45 seconds, followed by shut down.

Yet another actuation device command signal alternative using accelerometers for drill string motion detection may include axial motion of the drill string in combination with rotation. For example, the drill string may be lifted quickly by three feet (0.91 meter), dropped by two feet (0.60 meter), then rotated at 30 rpm for 30 seconds, and stopped for 30 seconds.

In all of the foregoing embodiments where command signals generated by detection of one or more of rotational drill string movement, axial drill string movement, drilling fluid pressure, and drilling fluid and/or flow rate in various combinations, including combinations with time periods, are employed, the reference numerals 850 in the drawing figures are indicative of non-limiting examples of suitable locations, and presence of, sensors for detection of such parameters and circuitry for generation of command signals therefrom.

Thus, while certain embodiments have been described and shown in the accompanying drawings, such embodiments are merely illustrative and not restrictive of the scope of the invention, and this invention is not limited to the specific constructions and arrangements shown and described, since various other additions and modifications to, and deletions from, the described embodiments will be apparent to one of ordinary skill in the art. The scope of the invention is, accordingly, limited only by the claims that follow herein, and legal equivalents thereof.

What is claimed is:

1. An expandable apparatus, for use in a subterranean wellbore, comprising:

a tubular body comprising a fluid passageway;

a drive element disposed within the tubular body and coupled to one or more expandable features, the drive element operably associated with an end surface in communication with a chamber within the tubular body separate from the fluid passageway and operably associated with another end surface in communication with another chamber within the tubular body separate from the fluid passageway, wherein the another end surface has a larger surface area than the end surface, the drive element configured to move axially to extend the one or more expandable features; and a valve within the tubular body configured to selectively control the flow of drilling fluid from the fluid passageway into the another chamber.

2. The expandable apparatus of claim 1, wherein the end surface in communication with the chamber is exposed to the flow of drilling fluid in the chamber whenever a drilling fluid is introduced into the fluid passageway.

3. The expandable apparatus of claim 1, wherein the valve comprises:

a valve sleeve disposed within the fluid passageway of the tubular body and including at least one aperture in communication with the another chamber;

a movable valve cylinder comprising a bore for providing a flow restriction within the fluid passageway; and a spring configured and disposed to exert a bias force on the valve cylinder.

4. The expandable apparatus of claim 3, wherein the valve cylinder is operably coupled to the valve sleeve by at least one element carried by one of the valve sleeve and the valve cylinder engaged with a cooperative structure located in another of the valve sleeve and the valve cylinder, the at least one element and the cooperative structure, in combination, configured to control movement of the valve cylinder relative to the valve sleeve responsive to the bias force of the spring and selected application of a force provided by drilling fluid flow through a bore of the valve cylinder.

5. The expandable apparatus of claim 4, wherein the valve cylinder comprises at least one valve port alignable with the at least one aperture to communicate drilling fluid from the fluid passageway to the another chamber responsive to movement of the valve cylinder.

6. An expandable apparatus, for use in a subterranean wellbore, comprising:

a tubular body comprising a fluid passageway;

a drive element disposed within the tubular body and coupled to one or more expandable features, the drive element operably associated with an end surface in communication with an upper chamber within the tubular body separate from the fluid passageway and operably associated with another end surface in communication with a lower chamber within the tubular body separate from the fluid passageway, wherein the another end surface has a larger surface area than the end surface, the drive element configured to move axially to extend the one or more expandable features; and a valve within the tubular body configured to selectively control the flow of drilling fluid from the fluid passageway into the lower chamber, wherein the valve comprises:

at least one valve associated with a valve port that extends between the fluid passageway and the lower chamber;

an actuation device within the tubular body and separate from the drive element and coupled to the at least one valve to selectively open and close the at least one valve; and a controller operably coupled to the actuation device and configured to change a state of the actuation device in response to a command signal.

7. The expandable apparatus of claim 6, wherein the actuation device comprises a servo motor or a solenoid.

8. The expandable apparatus of claim 6, wherein the fluid passageway comprises:

at least two fluid ports longitudinally offset from each other, extending through a sidewall of the fluid passageway and coupling the fluid passageway to the upper chamber; and a necked down orifice disposed longitudinally between the at least two fluid ports.

9. A method of operating an expandable apparatus, for use in a subterranean wellbore, comprising:

flowing a drilling fluid through a fluid passageway in a tubular body of the expandable apparatus;

exerting a force on a drive element disposed within the tubular body sufficient to bias the drive element downward and to retract the one or more expandable features coupled to the drive element, wherein exerting a force on the drive element sufficient to bias the push sleeve axially downward comprises exerting the force with the drilling fluid in a chamber within the tubular body and on an end surface operably associated with the drive element in communication with the chamber, the end surface comprising a smaller surface area than a surface area of another end surface operably associated with the drive element and in communication with another chamber;

opening a valve between the fluid passageway and the another chamber, and flowing the drilling fluid into another chamber in communication with the other end surface; and exerting a force with the drilling fluid on the another end surface and moving the drive element axially upward to expand the one or more expandable features coupled to the drive element.

10. The method of claim 9, wherein opening the valve comprises:

biasing a valve cylinder disposed within a valve sleeve downward in response to a force applied on the valve cylinder by the flowing drilling fluid.

11. The method of claim 10, further comprising:

reducing the flow rate of the drilling fluid;

biasing the valve cylinder upward in response to a force exerted by a spring coupled to the valve cylinder and at least partially rotating the valve cylinder;

increasing the flow rate of the drilling fluid; and biasing the valve cylinder downward in response to a force applied on the valve cylinder by the flowing drilling fluid and at least partially rotating the valve cylinder.

12. The method of claim 9, wherein opening the valve comprises:

communicating a command signal to a controller; and changing the state of the valve in response to the command signal.

13. The method of claim 12, wherein communicating the command signal to the controller comprises rotating the expandable apparatus according to at least one combination of parameters including rotational speed of the expandable apparatus or a drill string secured thereto, axial movement of the expandable apparatus or a drill string secured thereto, flow rate of drilling fluid through a drill string secured to the expandable apparatus, flow or absence of flow of drilling fluid through a drill string secured to the expandable apparatus, at least one of a number and a pattern of drilling fluid pulses, and time.

14. An expandable apparatus, for use in a subterranean wellbore, comprising:

a tubular body comprising a fluid passageway;

a drive element disposed within the tubular body and coupled to one or more expandable features, the drive element operably associated with an end surface disposed in a chamber within the tubular body and configured to move axially responsive to a flow of drilling fluid through the fluid passageway to extend and retract the one or more expandable features; and a valve independent of the drive element within the tubular body configured to selectively control the flow of drilling fluid from the fluid passageway into the chamber.

15. The expandable apparatus of claim 14, wherein the valve comprises a stationary valve sleeve having a longitudinally movable trap disposed therein and configured to obstruct one or more fluid ports extending between the fluid passageway and the chamber while passing a fluid through a central portion thereof.

16. The expandable apparatus of claim 15, wherein the trap is configured to trap a flow restricting element on a seat located in a bore thereof and is releasable from the valve sleeve responsive to axially downward fluid pressure when the flow restricting element is on the seat.

17. The expandable apparatus of claim 16, further comprising a catcher located within the fluid passageway below the valve and sized to receive at least one trap and one flow restricting element therein.

* * * * *